US008073696B2

(12) United States Patent
Kato et al.

(10) Patent No.: US 8,073,696 B2
(45) Date of Patent: Dec. 6, 2011

(54) VOICE SYNTHESIS DEVICE

(75) Inventors: Yumiko Kato, Osaka (JP); Takahiro Kamai, Kyoto (JP)

(73) Assignee: Panasonic Corporation, Osaka (JP)

( * ) Notice: Subject to any disclaimer, the term of this patent is extended or adjusted under 35 U.S.C. 154(b) by 578 days.

(21) Appl. No.: 11/914,427

(22) PCT Filed: May 2, 2006

(86) PCT No.: PCT/JP2006/309144

§ 371 (c)(1),
(2), (4) Date: Nov. 14, 2007

(87) PCT Pub. No.: WO2006/123539

PCT Pub. Date: Nov. 23, 2006

(65) Prior Publication Data

US 2009/0234652 A1 Sep. 17, 2009

(30) Foreign Application Priority Data

May 18, 2005 (JP) ..... 2005-146027

(51) Int. Cl.
*G10L 13/08* (2006.01)
*G10L 13/06* (2006.01)

(52) U.S. Cl. ..... 704/260; 704/266; 704/268

(58) Field of Classification Search ..... 704/254, 704/258, 260–261, 266–270
See application file for complete search history.

(56) References Cited

U.S. PATENT DOCUMENTS

2003/0163320 A1* 8/2003 Yamazaki et al. ..... 704/270
2004/0019484 A1* 1/2004 Kobayashi et al. ..... 704/258

FOREIGN PATENT DOCUMENTS

| | | |
|---|---|---|
| JP | 7-072900 | 3/1995 |
| JP | 9-252358 | 9/1997 |
| JP | 2002-268699 | 9/2002 |
| JP | 2002-311981 | 10/2002 |
| JP | 2003-233388 | 8/2003 |
| JP | 2003-271174 | 9/2003 |
| JP | 2003-302992 | 10/2003 |
| JP | 2003-337592 | 11/2003 |
| JP | 2004-279436 | 10/2004 |

OTHER PUBLICATIONS

International Search Report issued Jun. 13, 2006 in the International (PCT) Application of which the present application is the U.S. National Stage.
"Examination of speaker adaptation method in voice quality conversion based on HMM speech synthesis" The Acoustical Society of Japan, lecture papers, vol. 1, p. 320, 2nd column with partial English translation.

* cited by examiner

*Primary Examiner* — Angela A Armstrong
(74) *Attorney, Agent, or Firm* — Wenderoth, Lind & Ponack, L.L.P.

(57) ABSTRACT

A voice synthesis device is provided to include: an emotion input unit obtaining an utterance mode of a voice waveform, a prosody generation unit generating a prosody, a characteristic tone selection unit selecting a characteristic tone based on the utterance mode; and a characteristic tone temporal position estimation unit (i) judging whether or not each of phonemes included in a phonologic sequence of text is to be uttered with the characteristic tone, based on the phonologic sequence, the characteristic tone, and the prosody, and (ii) deciding a phoneme, which is an utterance position where the text is uttered with the characteristic tone. The voice synthesis device also includes an element selection unit and an element connection unit generating the voice waveform based on the phonologic sequence, the prosody, and the utterance position, so that the text is uttered in the utterance mode with the characteristic tone at the determined utterance position.

5 Claims, 37 Drawing Sheets

PRIOR ART

FIG. 6

620

| Tone | Estimation Equation | Threshold Value |
|---|---|---|
| Pressed | F1 | TH1 |
| Breathy | F2 | TH2 |
| Cracked | F3 | TH3 |
| | | |

FIG. 26

| Emotion | Tone 1 | Tone 1 Occurrence Frequency | Tone 2 | Tone 2 Occurrence Frequency | Tone 3 | Tone 3 Occurrence Frequency |
|---|---|---|---|---|---|---|
| Rage | Pressed | 5 | Cracked | 2 | Breathy | 1 |
| Nervousness | Breathy | 4 | Cracked | 3 | | |
| ... | | | | | | |

FIG. 32

About ten minutes is required.
Ju'ppun hodo / kakarima'su.
(a) ジュ' ップンホド/カカリマ' ス.

Ju'<numeral>ppun<temporal numerative>hodo<sub-particle>/
kakari<verb>ma'su<auxiliary verb>.
(b) ジュ' ッ<数詞>プン<時間助数詞>ホド<副助詞>/カカリ<動詞>マ' ス<助動詞>.

FIG. 35

(a)

<voice emotion = anger[5]>
10分ほどかかります。
About ten minutes is required.
</voice>

(b)

<voice emotion = anger[5]>
ジュ' ップンホド/カカリマ' ス.
Ju'ppun hodo / kakarima'su.
</voice>

VOICE SYNTHESIS DEVICE

BACKGROUND OF THE INVENTION

1. Field of Invention

The present invention relates to a voice synthesis device which makes it possible to generate a voice that can express tension and relaxation of a phonatory organ, emotion, expression of the voice, or an utterance style.

2. Description of the Related Art

Conventionally, as a voice synthesis device or method thereof by which emotion or the like is able to be expressed, it has been proposed to firstly synthesize standard or expressionless voices, then select a voice with a characteristic vector, which is similar to the synthesized voice and is perceived like a voice with expression such as emotion, and connects the selected voices (see Patent Reference 1, for example).

It has been further proposed to previously learn, using a neural network, a function for converting a synthesis parameter used to convert a standard or expressionless voice into a voice having expression such as emotion, and then convert, using the learned conversion function, the parameter sequence used to synthesize the standard or expressionless voice (see Patent Reference 2, for example).

It has been still further proposed to convert voice quality, by transforming a frequency characteristic of the parameter sequence used to synthesize the standard or expressionless voice (see Patent Reference 3, for example).

It has been still further proposed to convert parameters using parameter conversion functions whose change rates are different depending on degrees of emotion in order to control the degrees of emotion, or generate parameter sequences by compensating for two kinds of synthesis parameter sequences whose expressions are different from each other in order to mix multiple kinds of expressions (see Patent Reference 4, for example).

In addition to the above propositions, a method has been proposed to statistically learn, from natural voices including respective emotion expressions, voice generation models using hidden Markov models (HMM) which correspond to the respective emotions, then prepare respective conversion equations between the models, and convert a standard or expressionless voice into a voice expressing emotion (see Non-Patent Reference 1, for example).

FIG. 1 is a diagram showing the conventional voice synthesis device described in Patent Reference 4.

In FIG. 1, an emotion input interface unit 109 converts inputted emotion control information into parameter conversion information, which represents temporal changes of proportions of respective emotions as shown in FIG. 2, and then outputs the resulting parameter conversion information into an emotion control unit 108. The parameter conversion information 108 converts the parameter conversion information into a reference parameter according to predetermined conversion rules as shown in FIG. 3, and thereby controls operations of a prosody control unit 103 and a parameter control unit 104. The prosody control unit 103 generates an emotionless prosody pattern from a sequence of phonemes (hereinafter, referred to as a "phonologic sequence") and language information, which are generated by a language processing unit 101 and selected by a selection unit 102, and after that, converts the resulting emotionless prosody pattern into a prosody pattern having emotion, based on the reference parameter generated by the emotion control unit 108. Furthermore, the parameter control unit 104 converts a previously generated emotionless parameter such as a spectrum or an utterance speed, into an emotion parameter, using the above-mentioned reference parameter, and thereby adds emotion to the synthesized speech.

Patent Reference 1: Japanese Unexamined Patent Application Publication No. 2004-279436, pages 8-10, FIG. 5.

Patent Reference 2: Japanese Unexamined Patent Application Publication No. 7-72900, pages 6 and 7, FIG. 1.

Patent Reference 3: Japanese Unexamined Patent Application Publication No. 2002-268699, pages 9 and 10, FIG. 9.

Patent Reference 4: Japanese Unexamined Patent Application Publication No. 2003-233388 pages 8-10, FIGS. 1, 3, and 6.

Non-Patent Reference 1: "Consideration of Speaker-Adapting Method for Voice Quality Conversion based on HMM Voice Synthesis", Masanori Tamura, Takashi Mashiko, Eiichi Tokuda, and Takao Kobayashi, The Acoustical Society of Japan, Lecture Papers, volume 1, pp. 319-320, 1998.

BRIEF SUMMARY OF THE INVENTION

In the conventional structures, the parameter is converted based on the uniform conversion rule as shown in FIG. 3, which is predetermined for each emotion, in order to express strength of the emotion using a change rate of the parameter of each sound. This makes it impossible to reproduce variations of voice quality in utterances. Such variations of voice quality are usually observed in natural utterances even for the same emotion type and the same emotion strength. For example, the voice becomes partially cracked (state where voice has extreme tone due to strong emotion) or partially pressed. As a result, there is a problem of difficulty in realizing such rich voice expressions with changes of the voice quality in utterances belonging to the same emotion or feeling, although the rich voice expressions are common in actual speeches which express emotion or feeling.

In order to solve the conventional problem, an object of the present invention is to provide a voice synthesis device which makes it possible to realize the rich voice expressions with changes of voice quality, which are common in actual speeches expressing emotion or feeling, in utterances belonging to the same emotion or feeling.

In accordance with an aspect of the present invention, the voice synthesis device includes: an utterance mode obtainment unit operable to obtain an utterance mode of a voice waveform for which voice synthesis is to be performed; a prosody generation unit operable to generate a prosody which is used when a language-processed text is uttered in the obtained utterance mode; a characteristic tone selection unit operable to select a characteristic tone based on the utterance mode, the characteristic tone is observed when the text is uttered in the obtained utterance mode; a storage unit in which a rule is stored, the rule being used to judge ease of occurrence of the characteristic tone based on a phoneme and a prosody; an utterance position decision unit operable to (i) judge whether or not each of phonemes included in a phonologic sequence of the text is to be uttered with the characteristic tone, based on the phonologic sequence, the characteristic tone, the prosody, and the rule, and (ii) decide a phoneme which is an utterance position where the text is uttered with the characteristic tone; a waveform synthesis unit operable to generate the voice waveform based on the phonologic sequence, the prosody, and the utterance position, so that, in the voice waveform, the text is uttered in the utterance mode and the text is uttered with the characteristic tone at the utterance position decided by the utterance position decision unit; and an occurrence frequency decision unit operable to decide an occurrence frequency based on the characteristic tone, by which the text is uttered with the characteristic tone, wherein the utterance position decision unit is operable to (i) judge whether or not each of the phonemes included in the phonologic sequence of the text is to be uttered with the characteristic tone, based on the phonologic sequence, the characteristic tone, the prosody, the rule, and the occurrence frequency, and (ii) decide a phoneme which is an utterance position where the text is uttered with the characteristic tone.

With the structure, it is possible to set characteristic tones, such as "pressed voice", at one or more positions in an utterance with emotional expression such as "anger". The characteristic tones of "pressed voice" characteristically occur in utterances with the emotion "anger". Here, the utterance position decision unit decides positions where the characteristic tones are set, per units of phonemes, based on the characteristic tones, sequences of phonemes, prosody, and rules. Thereby, the characteristic tones can be set at least partially at appropriate positions in an utterance, not at all positions for all phonemes in the generated waveform. As a result, it is possible to provide a voice synthesis device which makes it possible to realize rich voice expressions with changes of voice quality, in utterances belonging to the same emotion or feeling. Such rich voice expressions are common in actual speeches expressing emotion or feeling.

With the occurrence frequency decision unit, it is possible to decide an occurrence frequency (generation frequency) of each characteristic tone with which the text it to be uttered. Thereby, the characteristic tones are able to be set at appropriate occurrence frequencies within one utterance, which makes it possible to realize rich voice expressions which are perceived as natural by human-beings.

It is preferable that the occurrence frequency decision unit is operable to decide the occurrence frequency per one of a mora, a syllable, a phoneme, and a voice synthesis unit.

With the structure, it is possible to control, with accuracy, the occurrence frequency (generation frequency) of a voice having a characteristic tone.

In accordance with another aspect of the present invention, the voice synthesis device includes: an utterance mode obtainment unit operable to obtain an utterance mode of a voice waveform for which voice synthesis is to be performed; a prosody generation unit operable to generate a prosody which is used when a language-processed text is uttered in the obtained utterance mode; a characteristic tone selection unit operable to select a characteristic tone based on the utterance mode, the characteristic tone is observed when the text is uttered in the obtained utterance mode; a storage unit in which a rule is stored, the rule being used to judge ease of occurrence of the characteristic tone based on a phoneme and a prosody; an utterance position decision unit operable to (i) judge whether or not each of phonemes included in a phonologic sequence of the text is to be uttered with the characteristic tone, based on the phonologic sequence, the characteristic tone, the prosody, and the rule, and (ii) decide a phoneme which is an utterance position where the text is uttered with the characteristic tone; and a waveform synthesis unit operable to generate the voice waveform based on the phonologic sequence, the prosody, and the utterance position, so that, in the voice waveform, the text is uttered in the utterance mode and the text is uttered with the characteristic tone at the utterance position decided by the utterance position decision unit, wherein the characteristic tone selection unit includes: an element tone storage unit in which (i) the utterance mode and (ii) a group of (ii-a) a plurality of the characteristic tones and (ii-b) respective occurrence frequencies in which the text is to be uttered with the plurality of the characteristic tones are stored in association with each other; and a selection unit operable to select from the element tone storage unit (ii) the group of (ii-a) the plurality of the characteristic tones and (ii-b) the respective occurrence frequencies, the group being associated with (i) the obtained utterance mode, wherein the utterance position decision unit operable to (i) judge whether or not each of phonemes included in the phonologic sequence of the text is to be uttered with any one of the plurality of the characteristic tones, based on the phonologic sequence, the group of the plurality of the characteristic tones and the respective occurrence frequencies, the prosody, and the rule, and (ii) decide a phoneme which is an utterance position where the text is uttered with the characteristic tone.

With the structure, a plurality of kinds of characteristic tones can be set within an utterance of one utterance mode. As a result, it is possible to provide a voice synthesis device which can realize richer voice expressions.

In addition, balance among the plurality of kinds of characteristic tones is appropriately controlled, so that it is possible to control the expression of synthesized speech with accuracy.

According to the voice synthesis device of the present invention, it is possible to reproduce variations of voice quality with characteristic tones, based on tension and relaxation of a phonatory organ, emotion, feeling of the voice, or utterance style. Like in natural speeches, the characteristic tones are observed partially in one utterance, as a cracked voice and a pressed voice. According to the voice synthesis device of the present invention, a strength of the tension and relaxation of a phonatory organ, the emotion, the feeling of the voice, or the utterance style is controlled according to an occurrence frequency of the characteristic tone. Thereby, it is possible to generate voices with the characteristic tones in the utterance, at more appropriate temporal positions. According to the voice synthesis device of the present invention, it is also possible to generate voices of a plurality of kinds of characteristic tones in one utterance in good balance. Thereby, it is possible to control complicated voice expression.

BRIEF DESCRIPTION OF THE DRAWINGS

FIG. 6 is a table showing one example of information which is recorded in an estimate equation/threshold value storage unit of the voice synthesis device of FIG. 5.

FIG. 26 is a table showing an example of information of (i) one or more kinds of characteristic tones corresponding to respective emotion expressions and (ii) respective occurrence frequencies of these characteristic tones, according to the third embodiment of the present invention.

FIG. 32 is a diagram showing one example of a text for which language processing has been performed.

FIG. 35 is a diagram showing one example of a text with a tag.

DETAILED DESCRIPTION OF THE INVENTION

First Embodiment

Figure 1:
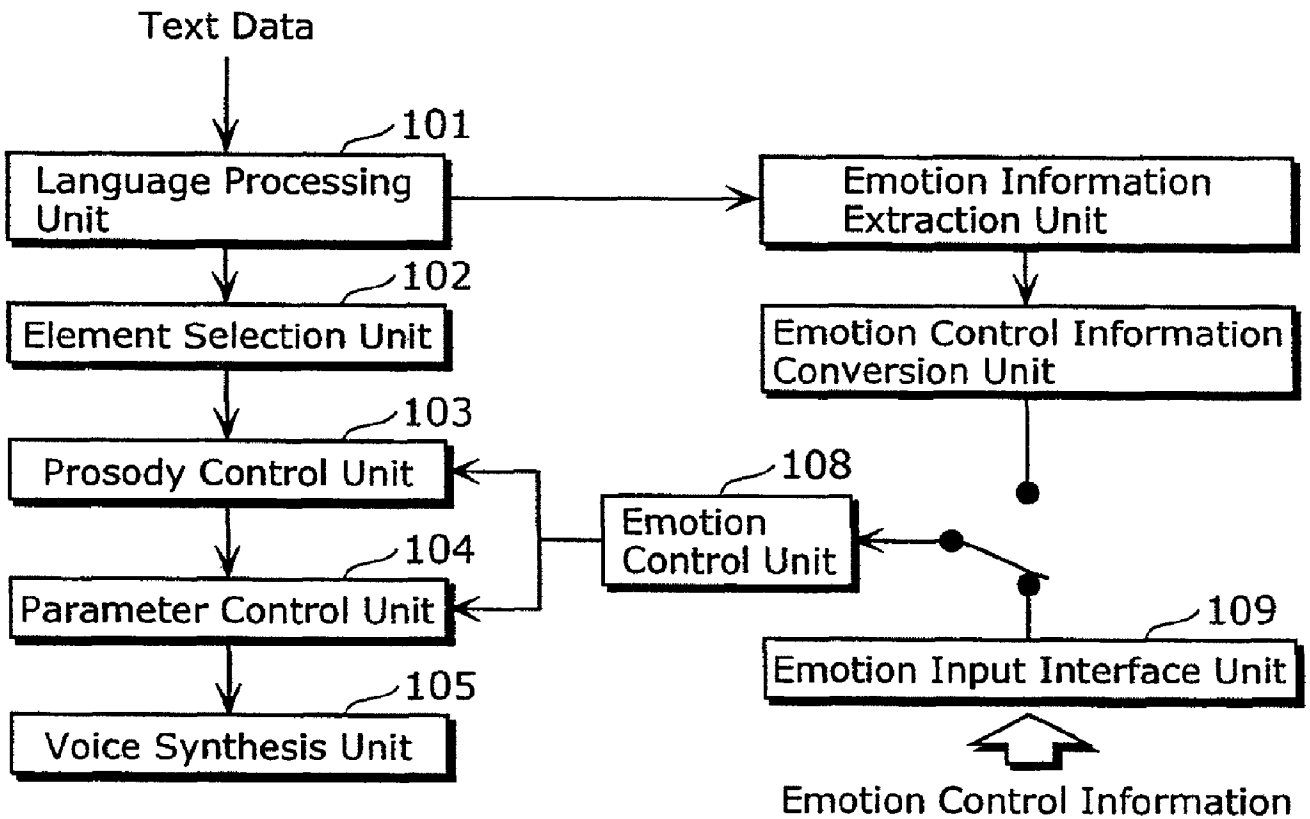
PRIOR ART FIG. 1
FIG. 1 is a block diagram of the conventional voice synthesis device.
Figure 2:
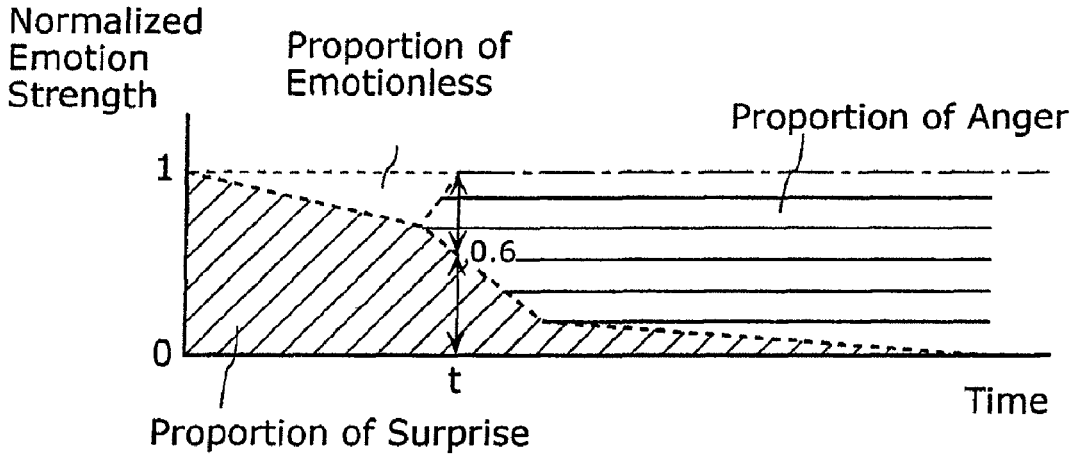
PRIOR ART FIG. 2
FIG. 2 is a graph sowing a method of mixing emotions by the conventional voice synthesis device.
Figure 3:
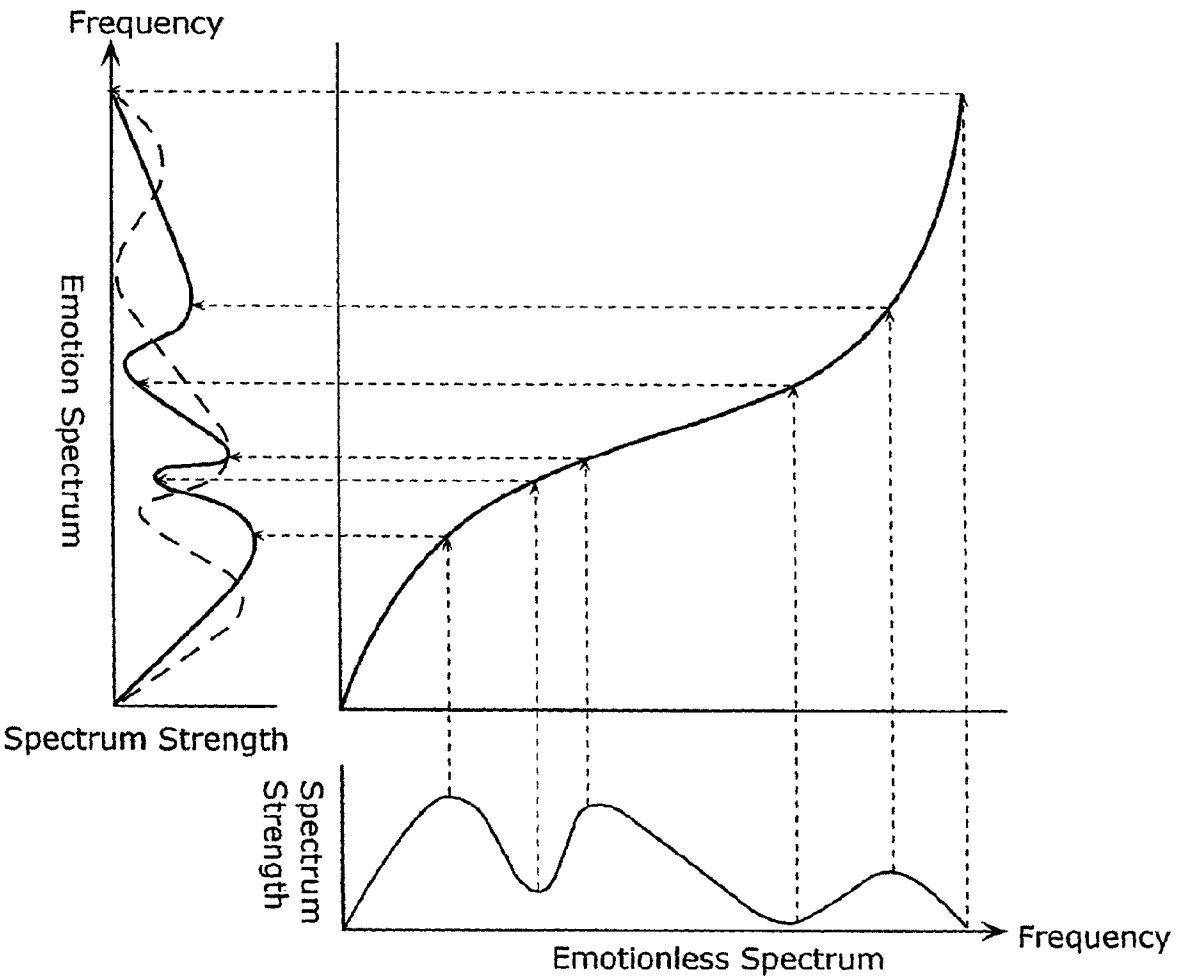
FIG. 3 is a graph of a conversion function for converting an emotionless voice into a voice with emotion, regarding the conventional voice synthesis device.
Figure 4:
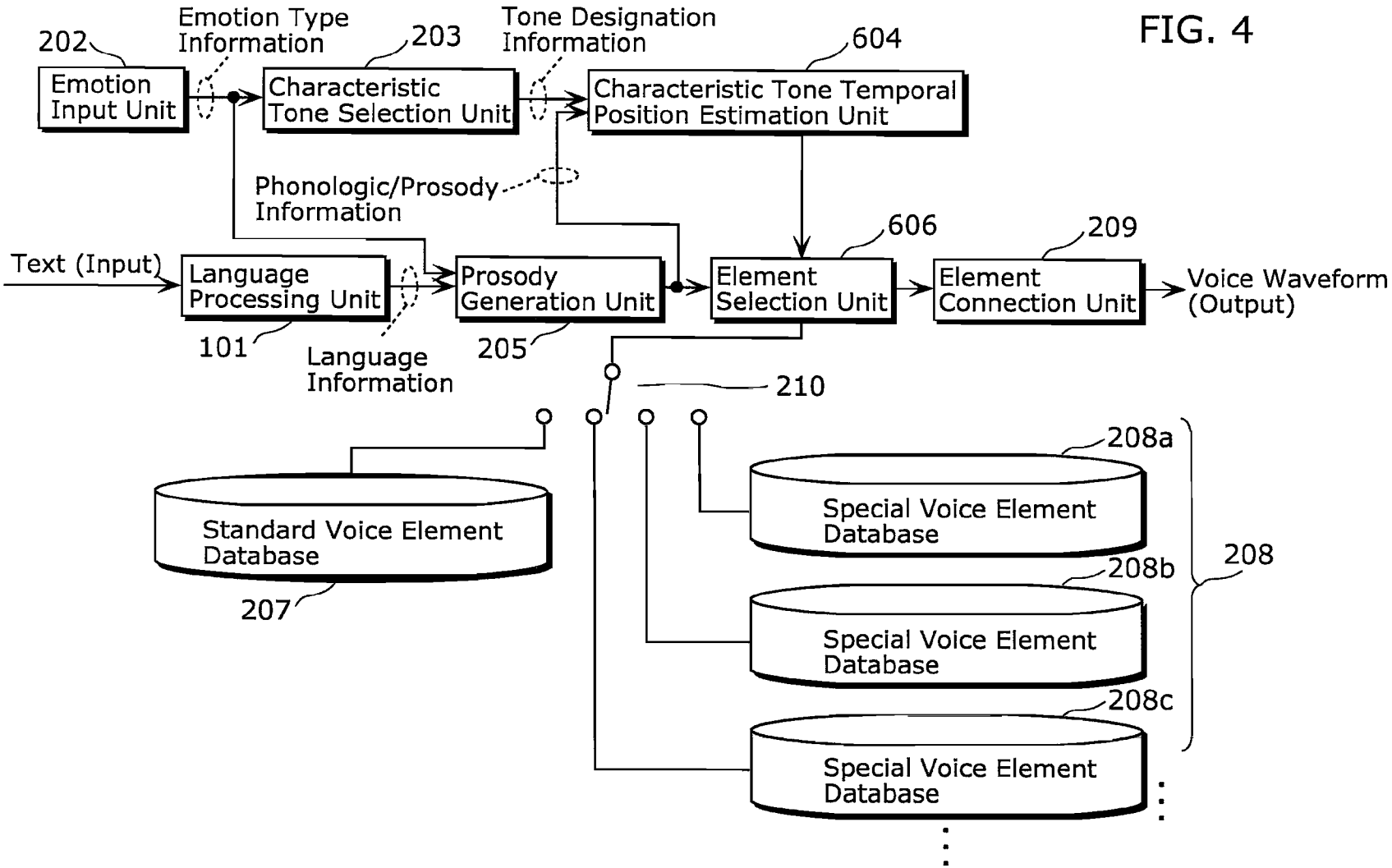
FIG. 4 is a block diagram of a voice synthesis device according to the first embodiment of the present invention.
Figure 5:
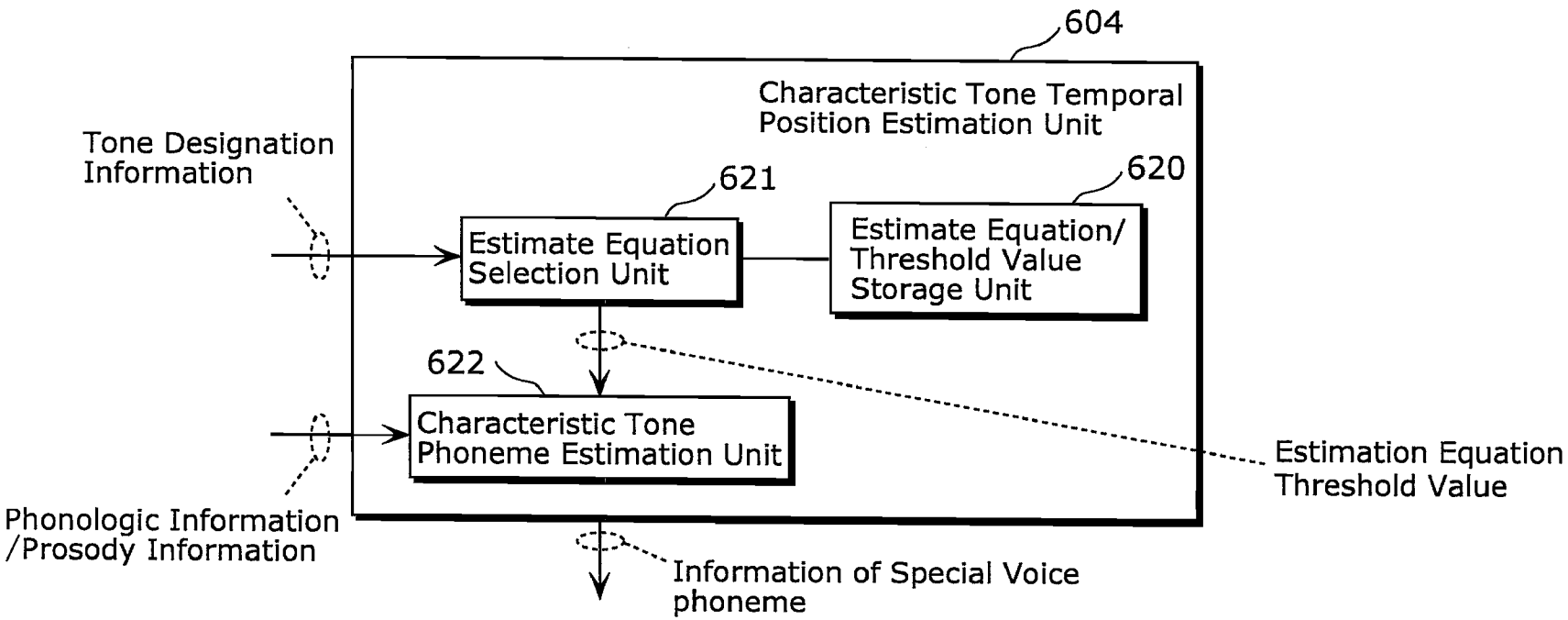
FIG. 5 is a block diagram showing a part of the voice synthesis device according to the first embodiment of the present invention.
Figure 7A:
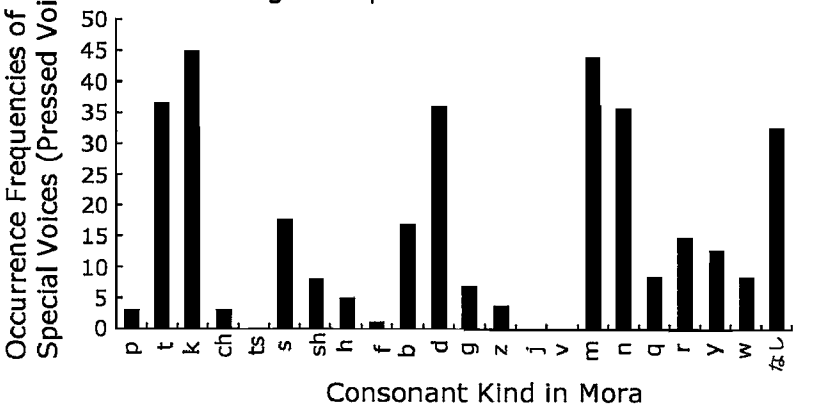
FIGS. 7A to 7D are graphs each showing occurrence frequencies of respective phonologic kinds of a characteristic-tonal voice in an actual speech.
Figure 7B:
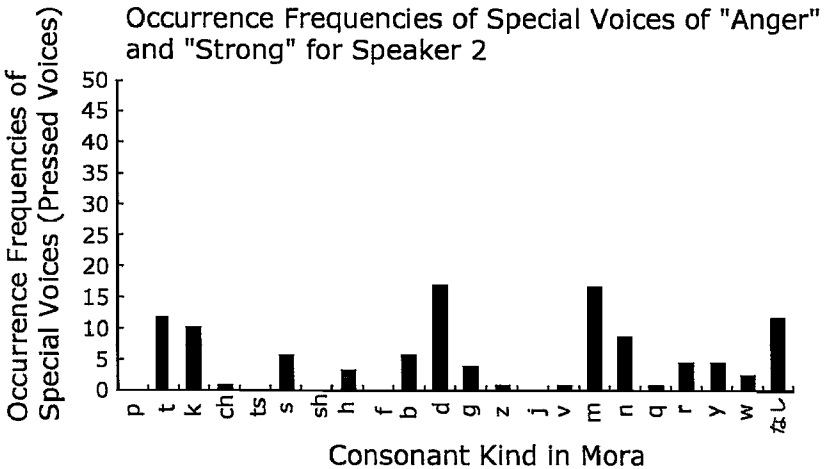
Figure 7C:
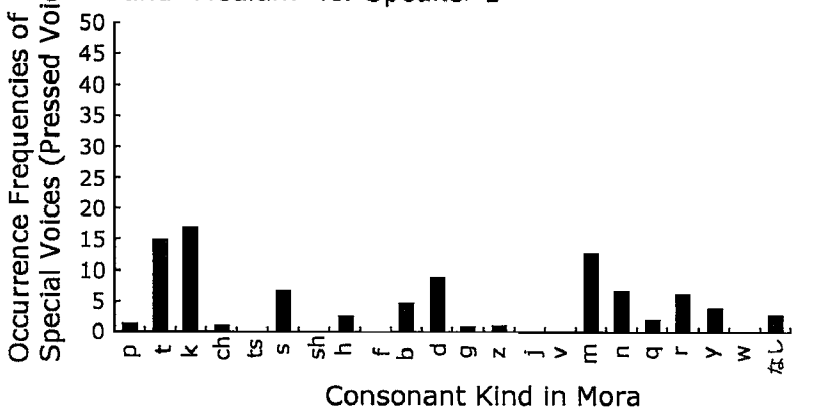
Figure 7D:
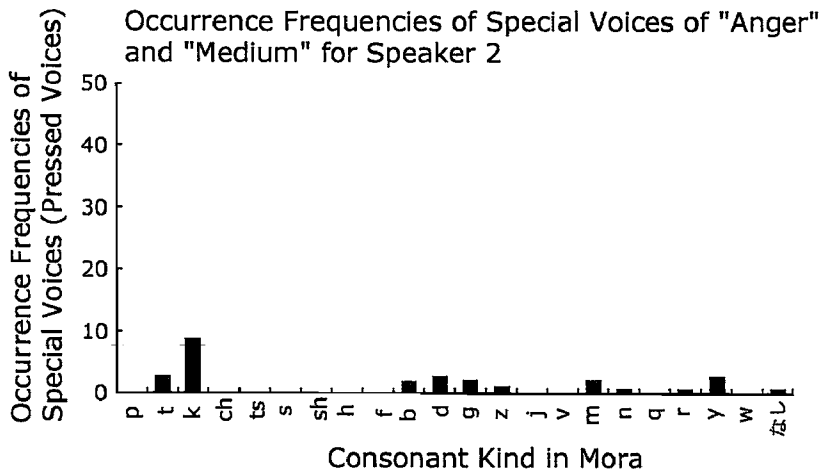
Figure 8:
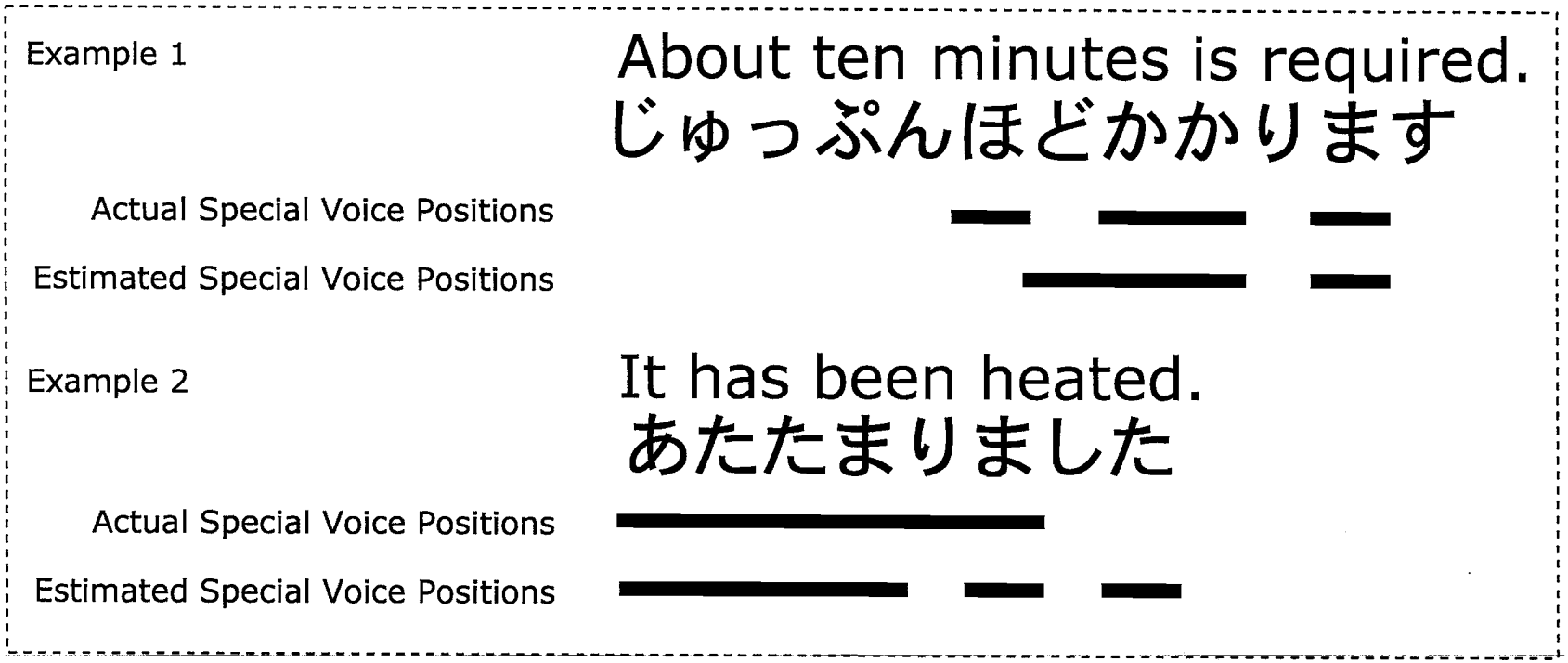
FIG. 8 is a diagram showing comparison of (i) respective occurrence positions of characteristic-tonal voices with (ii) respective estimated temporal positions of the characteristic-tonal voices, which is observed in an actual speech.
Figure 9:
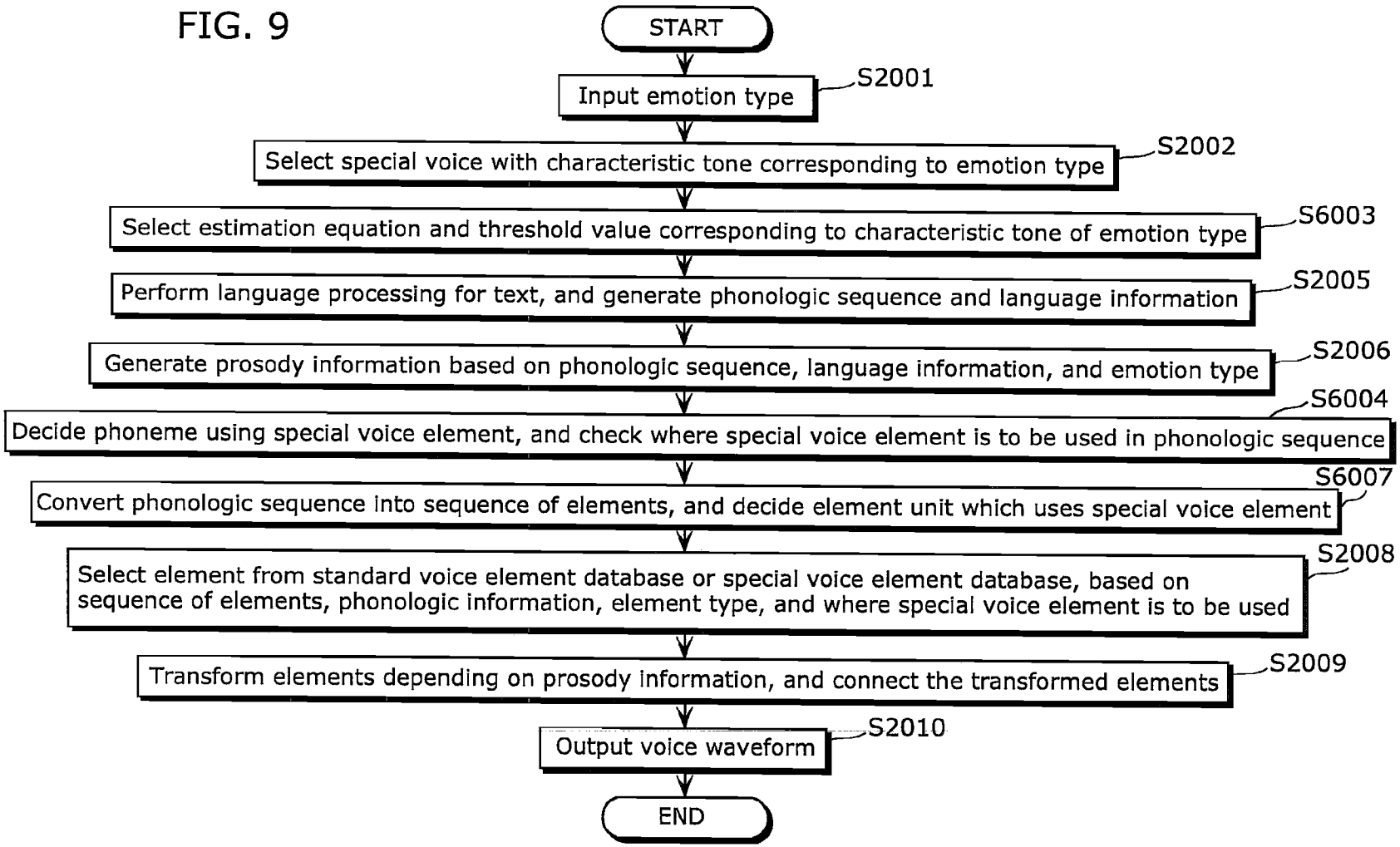
FIG. 9 is a flowchart showing processing performed by the voice synthesis device according to the first embodiment of the present invention.

FIGS. 4 and 5 are functional block diagrams showing a voice synthesis device according to the first embodiment of the present invention. FIG. 6 is a table showing one example of information which is recorded in an estimate equation/threshold value storage unit of the voice synthesis device of FIG. 5. FIGS. 7A to 7D are graphs each showing, for respective consonants, occurrence frequencies of characteristic tones, in naturally uttered voices. FIG. 8 is a diagram showing an example of estimated occurrence positions of special voices. FIG. 9 is a flowchart showing processing performed by the voice synthesis device according to the first embodiment of the present invention.

As shown in FIG. 4, the voice synthesis device according to the first embodiment includes an emotion input unit 202, a characteristic tone selection unit 203, a language processing unit 101, a prosody generation unit 205, a characteristic tone temporal position estimation unit 604, a standard voice element database 207, special voice element databases 208 (208*a*, 208*b*, 208*c*, . . . ), an element selection unit 606, an element connection unit 209, and a switch 210.

The emotion input unit 202 is a processing unit which receives emotion control information as an input, and outputs information of a type of emotion to be added to a target synthesized speech (hereinafter, the information is referred to also as "emotion type" or "emotion type information").

The characteristic tone selection unit 203 is a processing unit which selects a kind of characteristic tone for special voices, based on the emotion type information outputted from the emotion input unit 202, and outputs the selected kind of characteristic tone as tone designation information. The special voices with the characteristic tone are later synthesized (generated) in the target synthesized speech. This special voice is hereafter referred to as "special voice" or "characteristic-tonal voice". The language processing unit 101 is a processing unit which obtains an input text, and generates a phonologic sequence and language information from the input text. The prosody generation unit 205 is a processing unit which obtains the emotion type information from the emotion input unit 202, further obtains the phonologic sequence and the language information from the language processing unit 101, and eventually generates prosody information from those information. This prosody information is assumed to include information regarding accents, information regarding separation between accent phrases, fundamental frequency, power, and durations of a phoneme period and a silent period.

The characteristic tone temporal position estimation unit 604 is a processing unit which obtains the tone designation information, the phonologic sequence, the language information, and the prosody information, and determines based on them a phoneme which is to be generated as the above-mentioned special voice. The detailed structure of the characteristic tone temporal position estimation unit 604 will be later described further below.

The standard voice element database 207 is a storage device, such as a hard disk, in which elements of a voice (voice elements) are stored. The voice elements in the standard voice element database 207 are used to generate standard voices without characteristic tone. Each of the special voice element databases 208*a*, 208*b*, 208*c*, . . . , is a storage device for each characteristic tone, such as a hard disk, in which voice elements of the corresponding characteristic tone are stored. These voice elements are used to generate voices with characteristic tones (characteristic-tonal voices). The element selection unit 606 is a processing unit which (i) selects a voice element from the corresponding special voice element database 208, regarding a phoneme for the designated special voice, and (ii) selects a voice element from the standard voice element database 207, regarding a phoneme for other voice (standard voice). Here, the database from which desired voice elements are selected is chosen by switching the switch 210.

The element connection unit 209 is a processing unit which connects the voice elements selected by the element selection unit 606 in order to generate a voice waveform. The switch 210 is a switch which is used to switch a database to another according to designation of a kind of a desired element, so that the element selection unit 606 can connect to the switched database in order to select the desired element from (i) the standard voice element database 207 or (ii) one of the special voice element databases 208.

As shown in FIG. 5, the characteristic tone temporal position estimation unit 604 includes an estimate equation/threshold value storage unit 620, an estimate equation selection unit 621, and a characteristic tone phoneme estimation unit 622.

The estimate equation/threshold value storage unit 620 is a storage device in which (i) an estimate equation used to estimate a phoneme in which a special voice is to be generated and (ii) a threshold value are stored for each kind of characteristic tones, as shown in FIG. 6. The estimate equation selection unit 621 is a processing unit which selects the estimate equation and the threshold value from the estimate equation/threshold value storage unit 620, based on a kind of a characteristic tone which is designated in the tone designation information. The characteristic tone phoneme estimation unit 622 is a processing unit which obtains a phonologic sequence and prosody information, and determines based on the estimate equation and the threshold value whether or not each phoneme is generated as a special voice.

Prior to the description of processing performed by the voice synthesis device having the structure of the first embodiment, description is given for background of estimation performed by the characteristic tone temporal position estimation unit 604. In this estimation, temporal positions of special voices in a synthesized speech are estimated. Conventionally, it has been noticed that in any utterance there are common changes of a vocal expression with expression or emotion, especially common changes of voice quality. In order to realize the common changes, various technologies has been developed. It has been also known, however, that voices with expression or emotion are varied even in the same utterance style. In other words, even in the same utterance style, there are various voice quality which characterizes emotion or feeling of the voices and thereby gives impression to the voices ("Voice Quality from a viewpoint of Sound Sources", Hideki Kasutani and Nagamori Yo, Journal of The Acoustical Society of Japan, Vol. 51, No. 1, 1995, pp 869-875, for example). Note that voice expression can express additional meaning other than literal meaning or other meaning different from literal meaning, for example, state or intension of a speaker. Such voice expression is hereinafter called an "utterance mode". This utterance mode is determined based on information that includes data such as: an anatomical or physiological state such as tension and relaxation of a phonatory organ; a mental state such as emotion or feeling; phenomenon, such as feeling, reflecting a mental state; behavior or a behavior pattern of a speaker, such as an utterance style or a way of speaking, and the like. As described in the following embodiments, examples of the information for determining the utterance mode are types of emotion, such as "anger", "joy", "sadness", and "anger 3", or strength of emotion.

Here, prior to the following description, it is assumed that the research has previously performed for fifty utterance samples which have been uttered based on the same text (sentence), so that voices without expression and voices with emotion among the samples have been examined. FIG. 7A is a graph showing occurrence frequencies of moras which are uttered by a speaker 1 as "pressed" voices with emotion expression "strong anger" (or "harsh voice" in the document described in Background of Invention). The occurrence frequencies are classified by respective consonants in the moras. FIG. 7B is a graph showing, for respective consonants, occurrence frequencies of moras which are uttered by a speaker 2 as "pressed" voices with emotion expression "strong anger". FIGS. 7C and 7D are graphs showing, for respective consonants, occurrence frequencies of moras which are uttered by the speaker 1 of FIG. 7A and speaker 2 of FIG. 7B, respectively, as "pressed" voices with emotion expression "medium anger". Here, a mora is a fundamental unit of prosody for Japanese speech. A mora is a single short vowel, a combination of a consonant and a short vowel, a combination of a consonant, a semivowel, and a short vowel, or only mora phonemes. The occurrence frequency of a special voice is varied depending on a kind of a consonant. For example, a voice with consonant "t", "k", "d", "m", or "n", or a voice without any consonant has a high occurrence frequency. On the other hand, a voice with consonant "p", "ch", "ts", or "f", has a low occurrence frequency.

Comparing these graphs of FIGS. 7A and 7B regarding the two different speakers, it is understood that the occurrence frequencies of special voices for the respective consonants have the same bias tendency between these graphs. Therefore, in order to add more natural emotion or feeling into a synthesized speech, it is necessary to generate characteristic-tonal voices at more appropriate parts of an utterance. Furthermore, since there is the common bias tendency in the speakers, it is understood that occurrence positions of special voices in a phonologic sequence of a synthesized speech can be estimated using information such as kinds of phonemes or the like.

FIG. 8 is a diagram showing a result of such estimation by which moras uttered as "pressed" voices are estimated in an utterance example 1 "Ju'ppun hodo/kakarima'su ('About ten minutes is required' in Japanese)" and an example 2 "Atatamari mashita ('Water is heated' in Japanese), according to estimate equations generated from the same data as FIGS. 7A to 7D using Quantification Method II that is one of statistical learning techniques. In FIG. 8, underling for kanas (Japanese alphabets) shows (i) moras which are uttered as special voices in an actually uttered speech, and also (ii) moras which are predicted to be occurred as special voices using an estimate equation F1 stored in the estimate equation/threshold value storage unit 620.

The moras which are predicted to be occurred as special voices in FIG. 8 are specified based on the estimate equation F1 using the Quantification Method II as described above. For each of moras in the result learning data, the estimate equation F1 is generated using the Quantification Method II as follows. For the estimate equation F1, information regarding a kind of phoneme and information regarding a position of the mora are represented by independent variables. Here, the information regarding a kind of phoneme indicates a kind of consonant, and a kind of a vowel, or a category of phoneme included in the mora. The information representing a position of the mora indicates a position of the mora within an accent phrase. Moreover, for the estimate equation F1, a binary value indicating whether or not a "pressed" voice is occurred is represented as a dependent variable. Note that, the moras which are predicted to occur as special voices in FIG. 8 are an estimation result in the case where a threshold value is determined so that an accuracy rate of the occurrence positions of special voices in the learning data becomes 75%. FIG. 8 shows that the occurrence of the special voices can be estimated with high accuracy, using the information regarding kinds of phonemes and accents.

The following describes processing performed by the voice synthesis device with the above-described structure, with reference to FIG. 9.

First, emotion control information is inputted to the emotion input unit 202, and an emotion type is extracted from the emotion control information (S2001). Here, the emotion control information is information which a user selects and inputs via an interface from plural kinds of emotions such as "anger", "joy", and "sadness" that are presented to the user. In this case, it is assumed that "anger" is inputted as the emotion type at step S2001.

Based on the inputted emotion type "anger", the characteristic tone selection unit 203 selects a tone ("Pressed Voice" for example) which is occurred characteristically in voices with emotion "anger", in order to be outputted as tone designation information (S2002).

Next, the estimate equation selection unit 621 in the characteristic tone temporal position estimation unit 604 obtains tone designation information. Then, from the estimate equation/threshold value storage unit 620 in which estimate equations and judgment threshold values are set for respective tones, the estimate equation selection unit 621 obtains an estimate equation F1 and a judgment threshold value TH1 corresponding to the obtained tone designation information, in other words, correspond to the "Pressed" tone that is characteristically occurred in "anger" voices.

Figure 10:
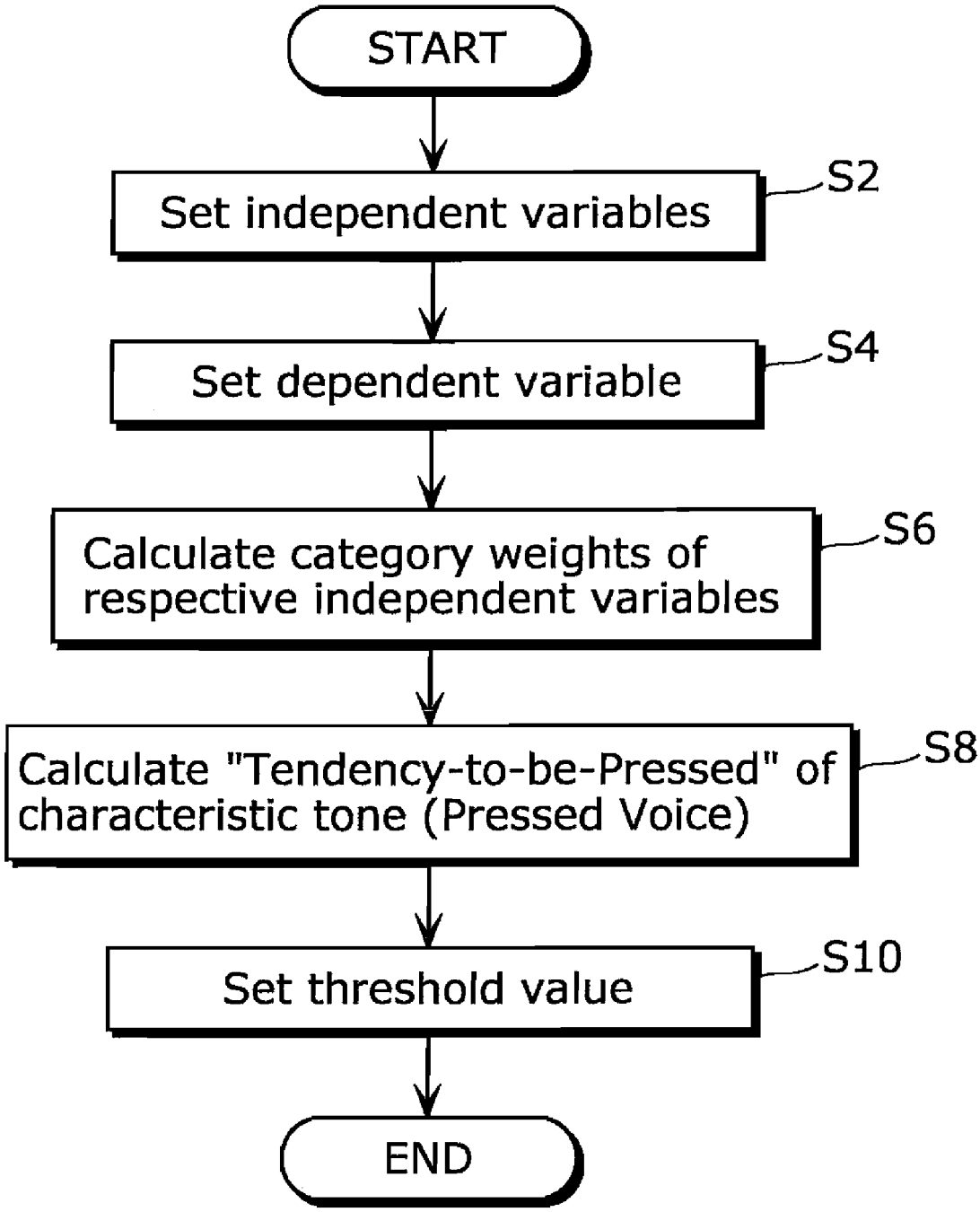
FIG. 10 is a flowchart showing a method of generating an estimate equation and a judgment threshold value.

Here, a method of generating the estimate equation and the judgment threshold value is described with reference to a flowchart of FIG. 10. In this case, it is assumed that "Pressed Voice" is selected as the characteristic tone.

First, a kind of a consonant, a kind of a vowel, and a position in a normal ascending order in an accent phrase are set as independent variables in the estimate equation, for each of moras in the learning voice data (S2). In addition, a binary value indicating whether or not each mora is uttered with a characteristic tone (pressed voice) is set as a dependent variable in the estimate equation, for each of the moras (S4). Next, a weight of each consonant kind, a weight of each vowel kind, and a weight in an accent phrase for each position in a normal ascending order are calculated as category weights for the respective independent variables, according to the Quantification Method II (S6). Then, "Tendency-to-be-Pressed" of a characteristic tone (pressed voice) is calculated, by applying the category weights of the respective independent variables to attribute conditions of each mora in the learning voice data (S8), so as to set the threshold valve (S10).

Figure 11:
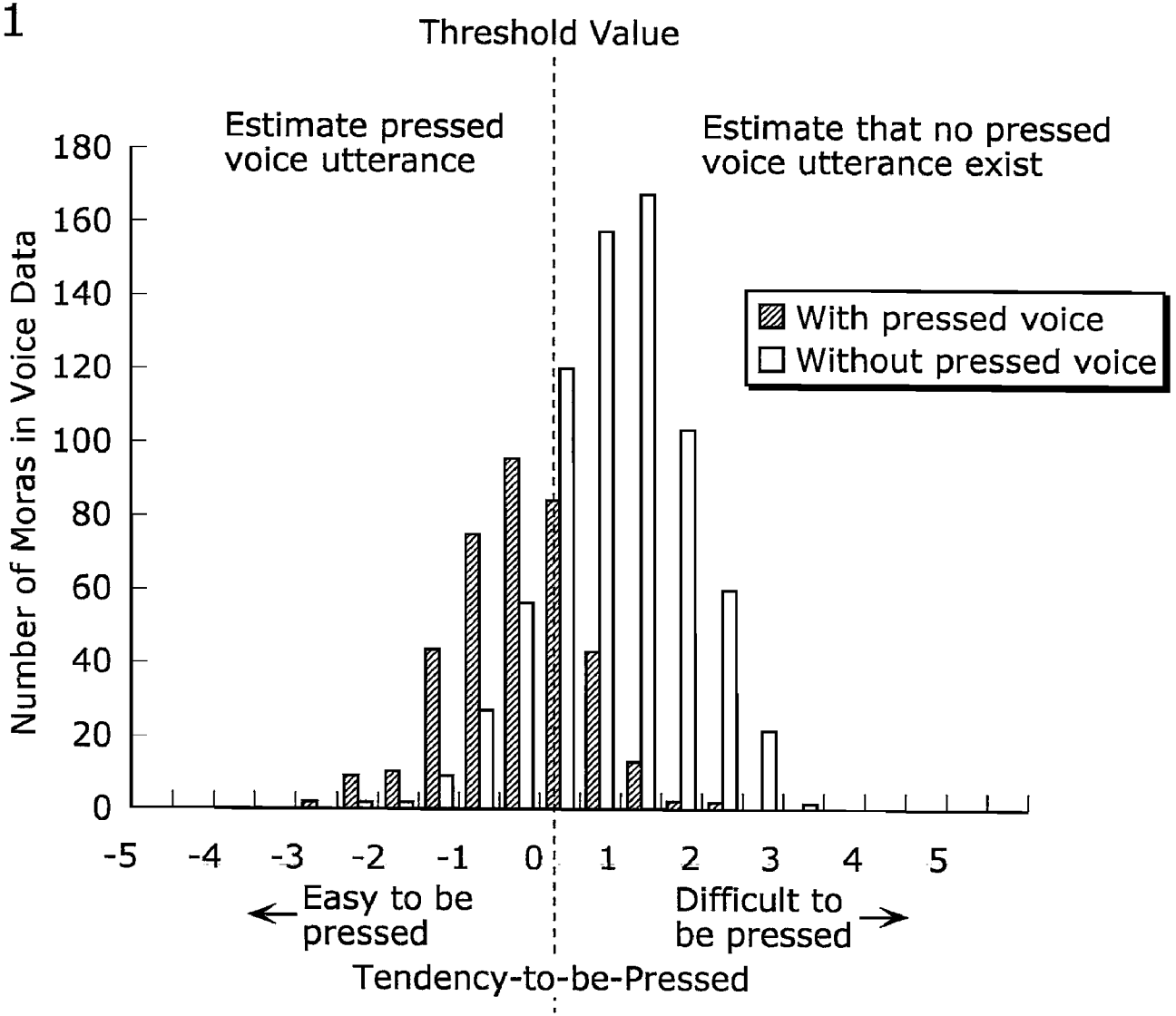
FIG. 11 is a graph where "Tendency-to-be-Pressed" is represented by a horizontal axis and "Number of Moras in Voice Data" is represented by a vertical axis.

FIG. 11 is a graph where "Tendency-to-be-Pressed" is represented by a horizontal axis and "Number of Moras in Voice Data" is represented by a vertical axis. The "Tendency-to-be-Pressed" ranges from "−5" to "5" in numeral values. With the smaller value, a voice is estimated to be uttered with greater tendency to be tensed. The hatched bars in the graph represent occurrence frequencies of moras which are actually uttered with the characteristic tones, in other words, which are uttered with "pressed" voice. The non-hatched bars in the graph represent occurrence frequencies of moras which are not actually uttered with the characteristic tones, in other words, which are not uttered with "pressed" voice.

In this graph, values of "Tendency-to-be-Pressed" are compared between (i) a group of moras which are actually uttered with the characteristic tones (pressed voices) and (ii) a group of moras which are actually uttered without the characteristic tones (pressed voices). Thereby, based on the "Tendency-to-be-Pressed", a threshold value is set so that accuracy rates of the both groups exceed 75%. Using the threshold value, it is possible to judge that a voice is uttered with a characteristic tone (pressed voice).

As described above, it is possible to calculate the estimate equation F1 and the judgment threshold value TH1 corresponding to the characteristic tone "Pressed Voice" which is characteristically occurred in voices with "anger".

Here, it is assumed that such an estimate equation and a judgment threshold value are set also for each of special voices corresponding to other emotions, such as "joy" and "sadness".

Referring back to FIG. 9, the language processing unit 101 receives an input text, then analyzes morphemes and syntax of the input text, and outputs (i) a phonologic sequence and (ii) language information such as accents' positions, word classes of the morphemes, degrees of connection between clauses, a distance between clauses, and the like (S2005).

The prosody generation unit 205 obtains the phonologic sequence and the language information from the language processing unit 101, and also obtains emotion type information designating an emotion type "anger" from the emotion input unit 202. Then, the prosody generation unit 205 generates prosody information which expresses literal meanings and emotion corresponding to the designated emotion type "anger" (S2006).

The characteristic tone phoneme estimation unit 622 in the characteristic tone temporal position estimation unit 604 obtains the phonologic sequence generated at step S2005 and the prosody information generated at step S2006. Then, the characteristic tone phoneme estimation unit 622 calculates a value by applying each phoneme in the phonologic sequence into the estimate equation selected at step S6003, and then compared the calculated value with the threshold value selected at step S6003. If the value of the estimate equation exceeds the threshold value, the characteristic tone phoneme estimation unit 622 decides that the phoneme is to be uttered with the characteristic tone, in other words, checks where special voice elements are to be used in the phonologic sequence (S6004). More specifically, the characteristic tone phoneme estimation unit 622 calculates a value of the estimate equation, by applying a consonant, a vowel, a position in an accent phrase of the phoneme, into the estimate equation of Quantification Method II which is used to estimate occurrence of a special voice "Pressed Voice" corresponding to "anger". If the value exceeds the threshold value, the characteristic tone phoneme estimation unit 622 judges that the phoneme should have a characteristic tone "Pressed Voice" in generation of a synthesized speech.

The element selection unit 606 obtains the phonologic sequence and the prosody information from the prosody generation unit 205. In addition, the element selection unit 606 obtains information of the phoneme in which a special voice is to be generated. The information is hereinafter referred to as "special voice phoneme information". As described above, the phonemes in which special voices are to be generated have been determined by the characteristic tone phoneme estimation unit 622 at S6004. Then, the element selection unit 606 applies the information into the phonologic sequence to be synthesized, converts the phonologic sequence (sequence of phonemes) into a sequence of element units, and decides an element unit which uses special voice elements (S6007).

Furthermore, the element selection unit 606 selects elements of voices (voice elements) necessary for the synthesizing, by switching the switch 210 to connect the element selection unit 606 with one of the standard voice element database 207 and the special voice element databases 208 in which the special voice elements of the designated kind are stored (S2008). The switching is performed based on positions of elements (hereinafter, referred to as "element positions") which are the special voice elements decided at step S6007, and element positions without the special voice elements.

In this example, among the standard voice element database 207 and the special voice element databases 208, the switch 210 is assumed to switch to a voice element database in which "Pressed" voice elements are stored.

Using a waveform superposition method, the element connection unit 209 transforms and connects the elements selected at Step S2008 according to the obtained prosody information (S2009), and outputs a voice waveform (S2010). Note that it has been described to connect the elements using the waveform superposition method at step S2009, it is also possible to connect the elements using other methods.

With the above structure, the voice synthesis device according to the first embodiment is characterized in including: the emotion input unit 202 which receives an emotion type as an input; the characteristic tone selection unit 203 which selects a kind of a characteristic tone corresponding to the emotion type; the characteristic tone temporal position estimation unit 604 which decides a phoneme in which a special voice is to be generated and which is with the characteristic tone, and includes the estimate equation/threshold value storage unit 620, the estimate equation selection unit 621, and the characteristic tone phoneme estimation unit 622; and the standard voice element database 207 and the special voice element databases 208 in which elements of voices that characteristic to voices with emotion are stored for each characteristic tone. With the above structure, in the voice synthesis device according to the present invention, temporal positions are estimated per phoneme depending on emotion types, by using the phonologic sequence, the prosody information, the language information, and the like. At the estimated temporal positions, characteristic-tonal voices, which occur at a part of an utterance of voices with emotion, are to be generated. Here, the units of phoneme are moras, syllables, or phonemes. Thereby, it is possible to generate a synthesized speech which reproduces various quality voices for expressing emotion, expression, an utterance style, human relationship, and the like in the utterance.

Furthermore, according to the voice synthesis device of the first embodiment, it is possible to imitate, with accuracy of phoneme positions, behavior which appears naturally and generally in human utterances in order to "express emotion, expression, and the like by using characteristic tone", not by changing voice quality and phonemes. Therefore, it is possible to provide the voice synthesis device having a high expression ability so that types and kinds of emotion and expression are intuitively perceived as natural.

(First Variation)

It has been described in the first embodiment that the voice synthesis device has the element selection unit 606, the standard voice element database 207, the special voice element databases 208, and the element connection unit 209, in order to realize voice synthesis by the voice synthesis method using a waveform superposition method. Instead of those units, however, a voice synthesis device according to the first variation of the first embodiment may have, as shown in FIG. 12: an element selection unit 706 which selects a parameter element; a standard voice parameter element database 307; a special voice conversion rule storage unit 308; a parameter transformation unit 309; and a waveform generation unit 310, in order to realize voice synthesis.

The standard voice parameter element database 307 is a storage device in which voice elements are stored. Here, the stored voice elements are standard voice elements described by parameters. These elements are hereinafter referred to as "standard parameter elements" or "standard voice parameter". The special voice conversion rule storage unit 308 is a storage device in which special voice conversion rules are stored. The special voice conversion rules are used to generate parameters for characteristic-tonal voices (special voice parameters) from parameters for standard voices (standard voice parameters). The parameter transformation unit 309 is a processing unit which generates, in other words, synthesizes, a parameter sequence of voices having desired phonemes, by transforming standard voice parameters according to the special voice conversion rule. The waveform generation unit 310 is a processing unit which generates a voice waveform from the synthesized parameter sequence.

Figure 12:
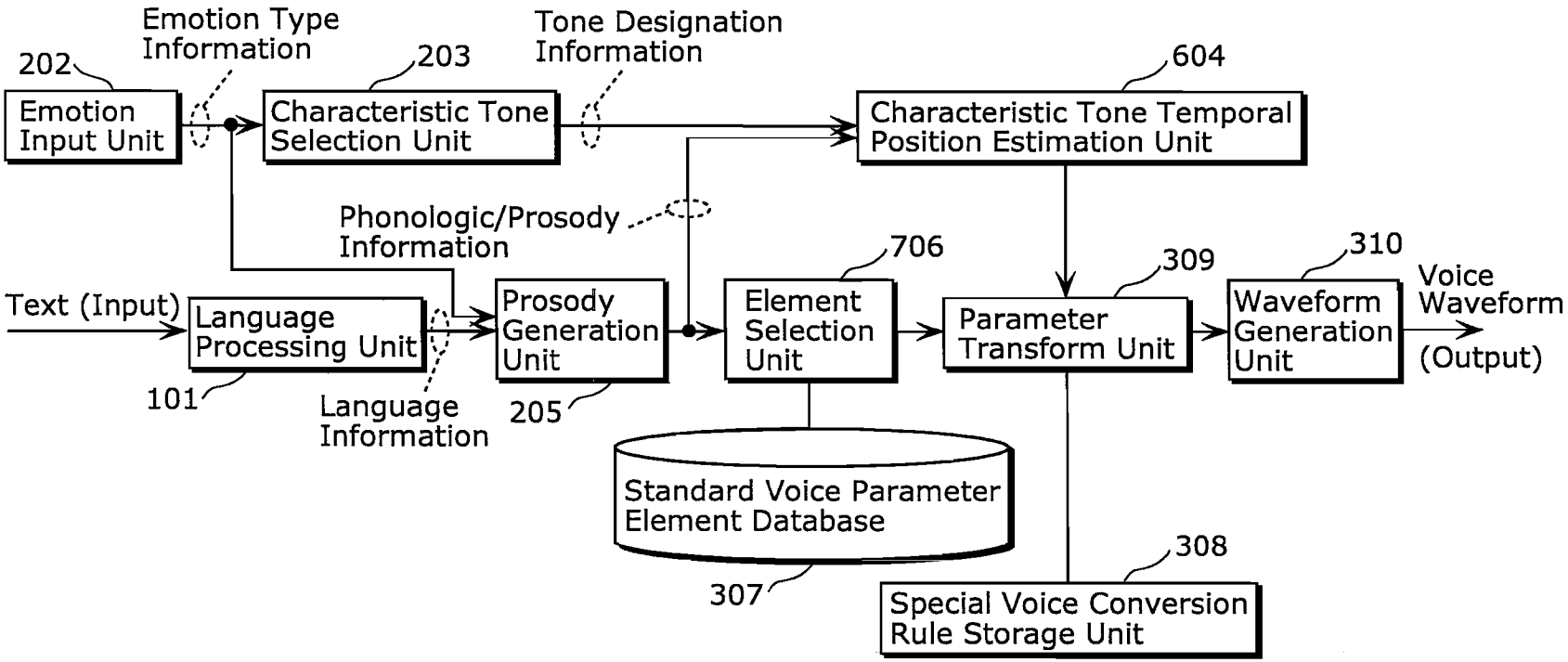
FIG. 12 is a block diagram of a voice synthesis device according to the first variation of the first embodiment of the present invention.
Figure 13:
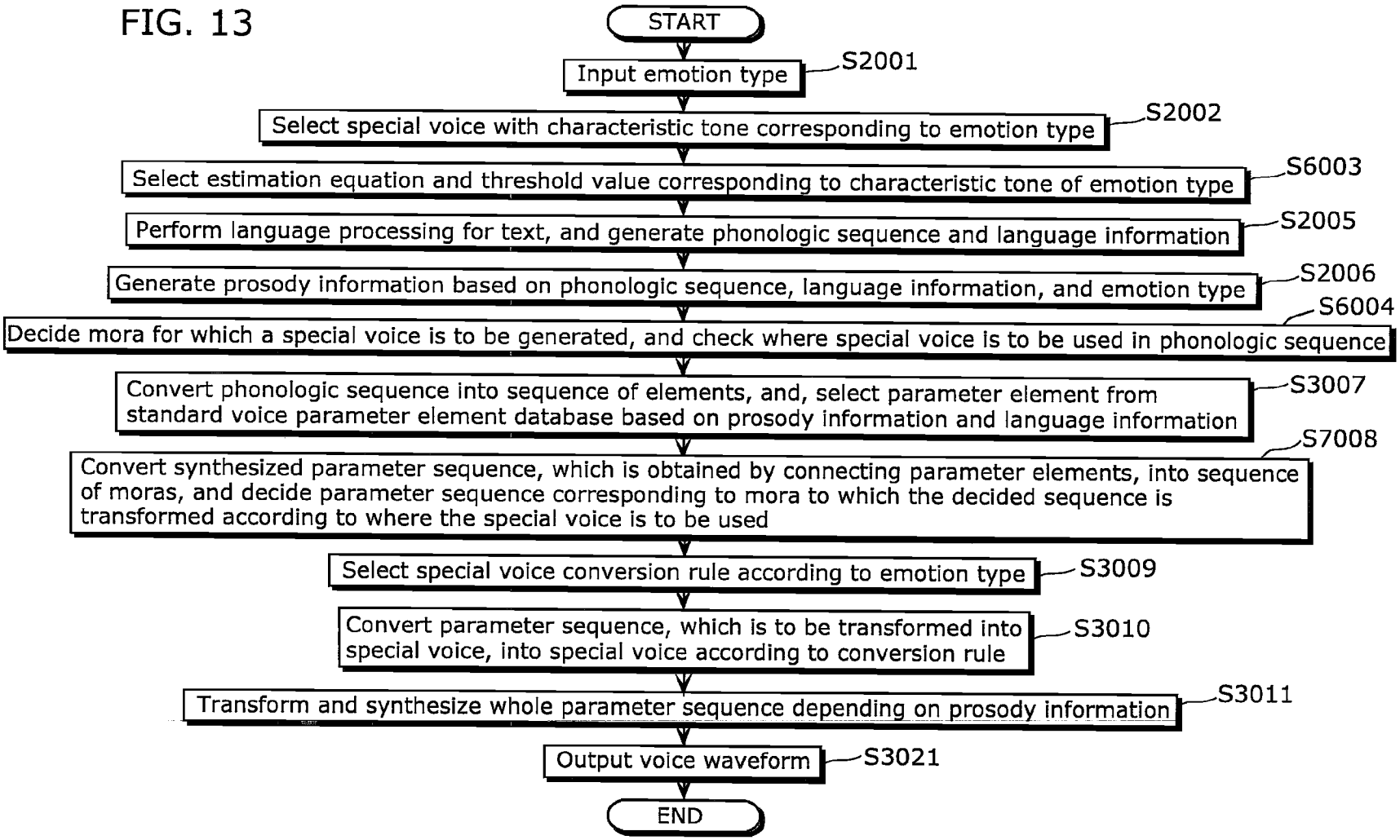
FIG. 13 is a flowchart showing processing performed by the voice synthesis device according to the first variation of the first embodiment of the present invention.

FIG. 13 is a flowchart showing processing performed by the speech synthesis device of FIG. 12. Note that the step numerals in FIG. 9 are assigned to identical steps in FIG. 13 so that the details of those steps are same as described above and not explained again below.

In the first embodiment, a phoneme in which a special voice is to be generated is decided by the characteristic tone phoneme estimation unit 622 at step S6004 of FIG. 9. In this first variation, however, a mora is decided for a phoneme as shown in FIG. 13.

The characteristic tone phoneme estimation unit 622 decides a mora for which a special voice is to be generated (S6004). The element selection unit 706 converts a phonologic sequence (sequence of phonemes) into a sequence of element units, and selects standard parameter elements from the standard voice parameter element database 307 according to kinds of the elements, the language information, and the prosody information (S3007). The parameter transformation unit 309 converts, into a sequence of moras, the parameter element sequence (sequence of parameter elements) selected by the element selection unit 706 at step S3007, and specifies a parameter sequence which is to be converted into a sequence of special voices according to positions of moras (S7008). The moras are moras for which special voices are to be generated and which have been decided by the characteristic tone phoneme estimation unit 622 at step S6004.

Moreover, the parameter transformation unit 309 obtains a conversion rule corresponding to the special voice selected at step S2002, from the special voice conversion rule storage unit 308 in which conversion rules are stored in association with respective special voices (S3009). The parameter transformation unit 309 converts the parameter sequence specified at step S7008 according to the obtained conversion rule (S3010), and then transforms the converted parameter sequence in accordance with the prosody information (S3011).

The waveform generation unit 310 obtains the transformed parameter sequence from the parameter transformation unit 309, and generates and outputs a voice waveform of the parameter sequence (S3021).

(Second Variation)

Figure 14:
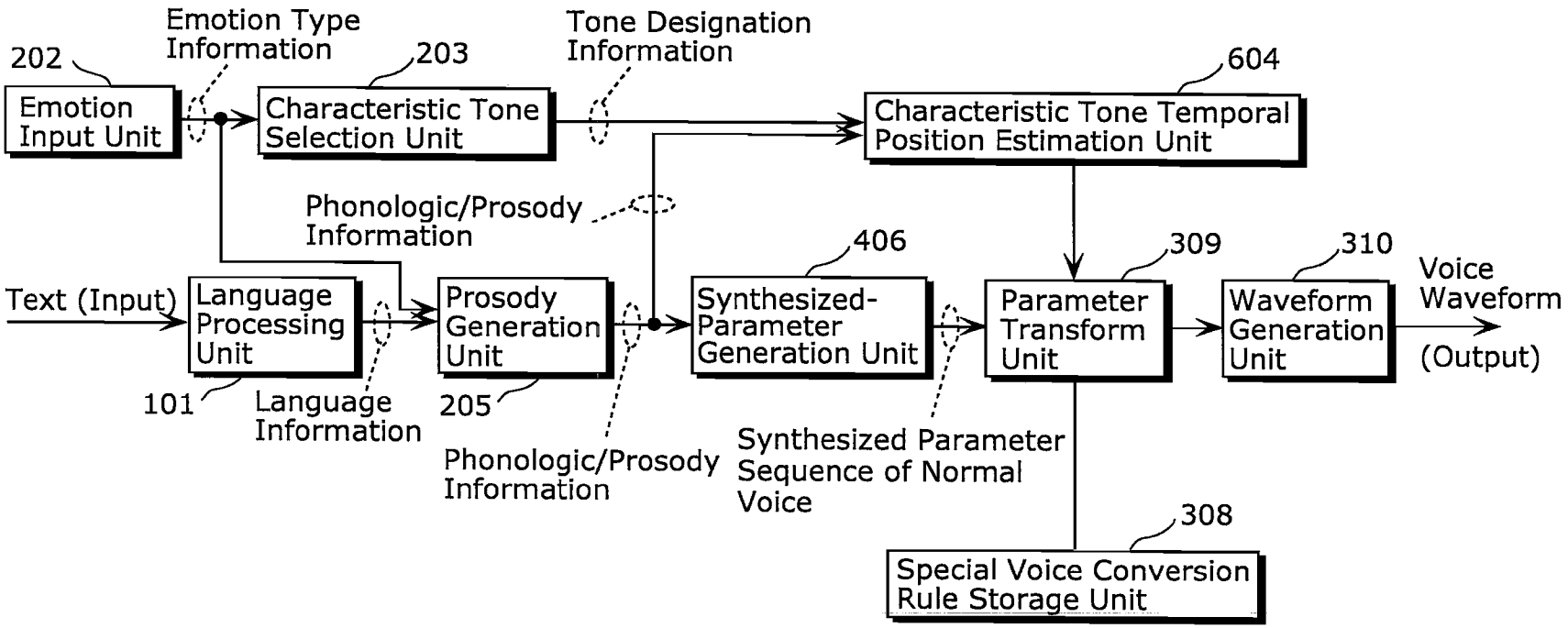
FIG. 14 is a block diagram of a voice synthesis device according to the second variation of the first embodiment of the present invention.

It has been described in the first embodiment that the voice synthesis device has the element selection unit 606, the standard voice element database 207, the special voice element databases 208, and the element connection unit 209, in order to realize voice synthesis by the voice synthesis method using a waveform superposition method. Instead of these units, however, the voice synthesis device according to the second variation of the first embodiment may have, as shown in FIG. 14: a synthesized-parameter generation unit 406; a special voice conversion rule storage unit 308; a parameter transformation unit 309; and a waveform generation unit 310. The synthesized-parameter generation unit 406 generates a parameter sequence of standard voices. The parameter transformation unit 309 generates a special voice from a standard voice parameter according to a conversion rule and realizes a voice of a desired phoneme.

Figure 15:
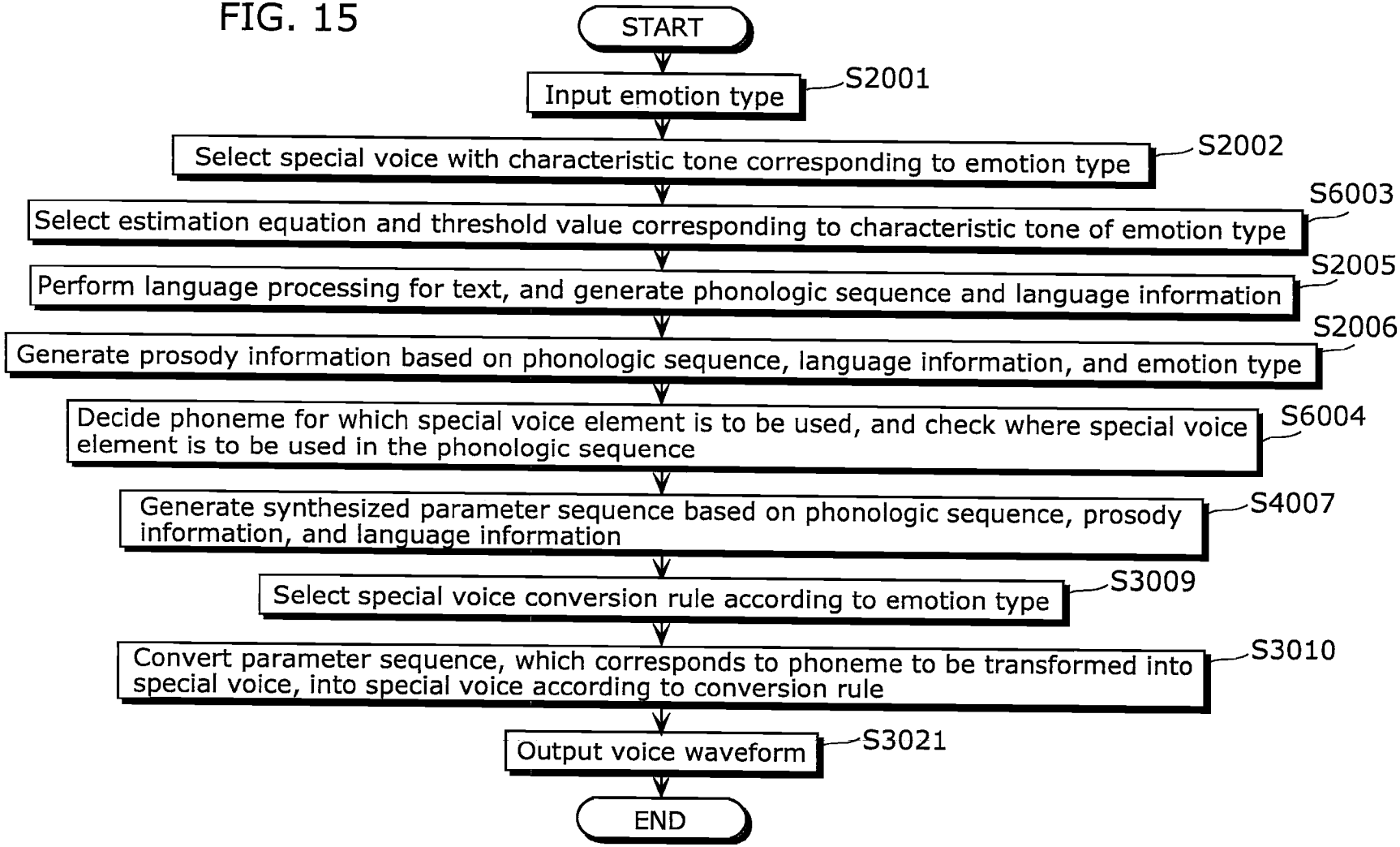
FIG. 15 is a flowchart showing processing performed by the voice synthesis device according to the second variation of the first embodiment of the present invention.

FIG. 15 is a flowchart showing processing performed by the speech synthesis device of FIG. 14. Note that the step numerals in FIG. 9 are assigned to identical steps in FIG. 15 so that the details of those steps are same as described above and not explained again below.

As shown in FIG. 15, the processing performed by the voice synthesis device of the second variation differs from the processing of FIG. 9 in processing following the step S6004. More specifically, in the second variation of the first embodiment, after the step S6004, the synthesized-parameter generation unit 406 generates, more specifically synthesizes, a parameter sequence of standard voices (S4007). The synthesizing is performed based on: the phonologic sequence and the language information generated by the language processing unit 101 at step S2005; and the prosody information generated by the prosody generation unit 205 at step S2006. Example of the prosody information is a predetermined rule using statistical learning such as the HMM.

The parameter transformation unit 309 obtains a conversion rule corresponding to the special voice selected at step S2002, from the special voice conversion rule storage unit 308 in which conversion rules are stored in association with respective kinds of special voices (S3009). The stored conversion rules are used to convert standard voices into special voices. According to the obtained conversion rule, the parameter transformation unit 309 converts a parameter sequence corresponding to a standard voice to be transformed into a special voice, and then converts a parameter of the standard voice into a special voice parameter (S3010). The waveform generation unit 310 obtains the transformed parameter sequence from the parameter transformation unit 309, and generates and outputs a voice waveform of the parameter sequence (S3021).

(Third Variation)

Figure 16:
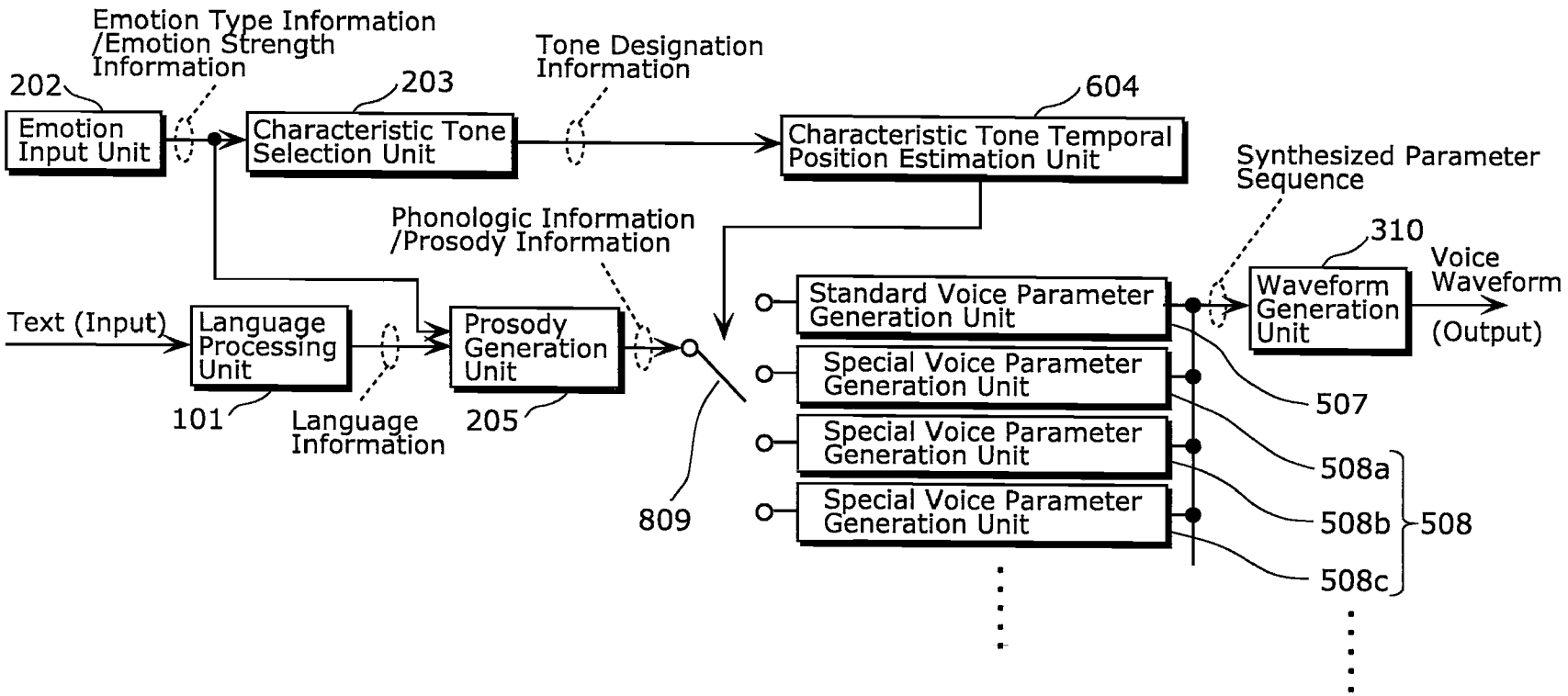
FIG. 16 is a block diagram of a voice synthesis device according to the third variation of the first embodiment of the present invention.

It has been described in the first embodiment that the voice synthesis device has the element selection unit 606, the standard voice element database 207, the special voice element databases 208, and the element connection unit 209, in order to realize voice synthesis by the voice synthesis method using a waveform superposition method. Instead of those units, however, the voice synthesis device according to the third variation of the first embodiment may have, as shown in FIG. 16: a standard voice parameter generation unit 507; one or more special voice parameter generation units 508 (508*a*, 508*b*, 508*c*, . . . ,); a switch 809; and a waveform generation unit 310. The standard voice parameter generation unit 507 generates a parameter sequence of standard voices. Each of the special voice parameter generation units 508 generates a parameter sequence of a characteristic-tonal voice (special voice). The switch 809 is used to switch between the standard voice parameter generation unit 507 and the special voice parameter generation units 508. The waveform generation unit 310 generates a voice waveform from a synthesized parameter sequence.

Figure 17:
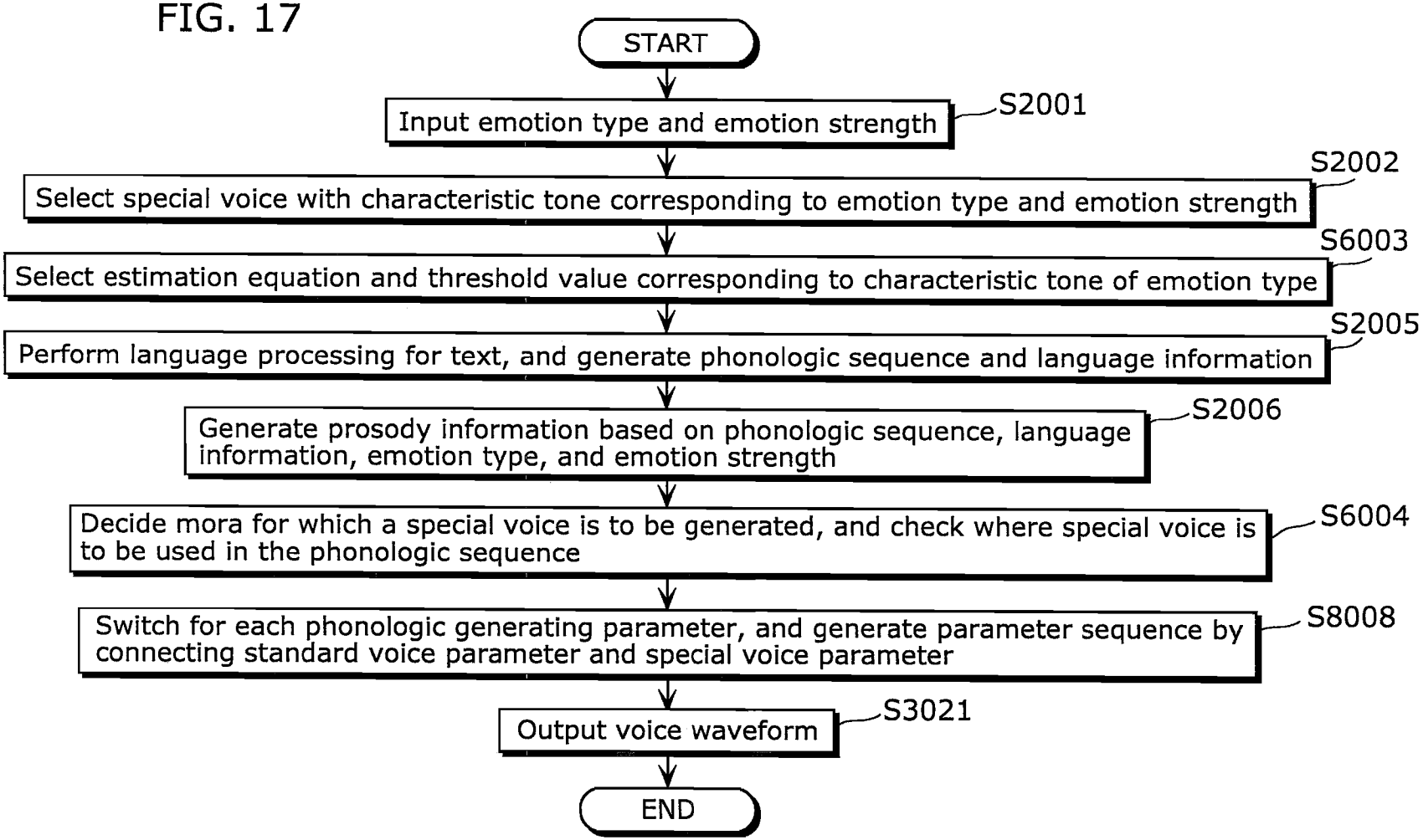
FIG. 17 is a flowchart showing processing performed by the voice synthesis device according to the third variation of the first embodiment of the present invention.

FIG. 17 is a flowchart showing processing performed by the speech synthesis device of FIG. 16. Note that the step numerals in FIG. 9 are assigned to identical steps in FIG. 17 so that the details of those steps are same as described above and not explained again below.

After the processing at step S2006, based on (i) the phonologic information regarding a phoneme in which a special voice is to be generated and which is generated at step S6004 and (ii) the tone designation information generated at step S2002, the characteristic tone phoneme estimation unit 622 operates the switch 809 for each phoneme to switch a parameter generation unit to another for synthesized parameter generation, so that the prosody generation unit 205 is connected to one of the standard voice parameter generation unit 507 and the special voice parameter generation units 508 in order to generate a special voice corresponding to the tone designation. In addition, the characteristic tone phoneme estimation unit 622 generates a synthesized parameter sequence in which standard voice parameters and special voice parameters are arranged according to the special voice phoneme information (S8008). The information has been generated at step S6004.

The waveform generation unit 310 generates and outputs a voice waveform of the parameter sequence (S3021).

In the first embodiment and its variations, a strength of emotion (hereinafter, referred to as a "emotion strength") is fixed, when a position of a phoneme in which a special voice is to be generated is estimated using an estimate equation and a threshold value which are stored for each emotion type. However, it is also possible to prepare a plurality of degrees of the emotion strength, so that an estimate equation and a threshold value are stored in accordance with each emotion type and each degree of emotion strength and a position of a phoneme in which a special voice is to be generated can be estimated based on the emotion type and the emotion strength as well as the estimate equation and the threshold value.

Note that, if each of the voice synthesis devices according to the first embodiment and its variations is implemented as a large-scale integration (LSI), it is possible to implement all of the characteristic tone selection unit 203, the characteristic tone temporal position estimation unit 604, the language processing unit 101, the prosody generation unit 205, the element selection unit 606, and the element connection unit 209, into a single LSI. It is further possible to implement these processing units as the different LSIs. It is still further possible to implement one processing unit as a plurality of LSIs. Moreover, it is possible to implement the standard voice element database 207 and the special voice element databases 208*a*, 208*b*, 208*c*, . . . , as a storage device outside the above LSI, or as a memory inside the LSI. If these databases are implemented as a storage device outside the LSI, data may be obtained from these databases via the Internet.

The above described LSI can be called an IC, a system LSI, a super LSI or an ultra LSI depending on their degrees of integration.

The integrated circuit is not limited to the LSI, and it may be implemented as a dedicated circuit or a general-purpose processor. It is also possible to use a Field Programmable Gate Array (FPGA) that can be programmed after manufacturing the LSI, or a reconfigurable processor in which connection and setting of circuit cells inside the LSI can be reconfigured.

Furthermore, if due to the progress of semiconductor technologies or their derivations, new technologies for integrated circuits appear to be replaced with the LSIs, it is, of course, possible to use such technologies to implement the functional blocks as an integrated circuit. For example, biotechnology can be applied to the above implementation.

Figure 18:
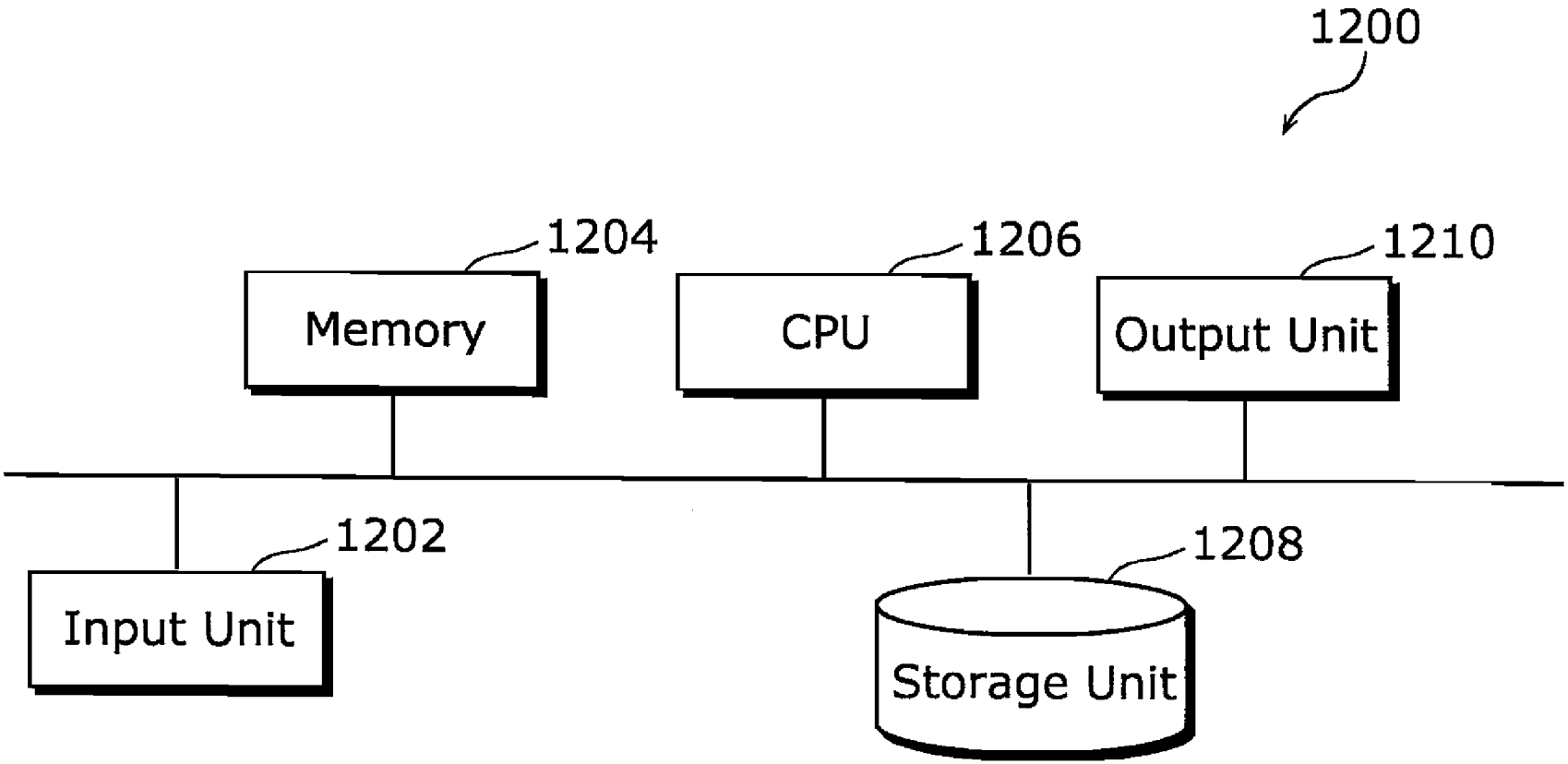
FIG. 18 is a diagram showing one example of a configuration of a computer.

Moreover, the voice synthesis devices according to the first embodiment and its variations can be implemented as a computer. FIG. 18 is a diagram showing one example of a configuration of such a computer. The computer 1200 includes an input unit 1202, a memory 1204, a central processing unit (CPU) 1206, a storage unit 1208, and an output unit 1210. The input unit 1202 is a processing unit which receives input data from the outside. The input unit 1202 includes a keyboard, a mouse, a voice input device, a communication interface (I/F) unit, and the like. The memory 1204 is a storage device in which programs and data are temporarily stored. The CPU 1206 is a processing unit which executes the programs. The storage unit 1208 is a device in which the programs and the data are stored. The storage unit 1208 includes a hard disk and the like. The output unit 1210 is a processing unit which outputs the data to the outside. The output unit 1210 includes a monitor, a speaker, and the like.

If the voice synthesis device is implemented as a computer, the characteristic tone selection unit 203, the characteristic tone temporal position estimation unit 604, the language processing unit 101, the prosody generation unit 205, the element selection unit 606, and the element connection unit 209 correspond to programs executed by the CPU 1206, and the standard voice element database 207 and the special voice element databases 208*a*, 208*b*, 208*c*, . . . are data stored in the storage unit 1208. Furthermore, results of calculation of the CPU 1206 are temporarily stored in the memory 1204 or the storage unit 1208. Note that the memory 1204 and the storage unit 1208 may be used to exchange data among the processing units including the characteristic tone selection unit 203. Note also that programs for executing each of the voice synthesis devices according to the first embodiment and its variations may be stored in a Floppy™ disk, a CD-ROM, a DVD-ROM, a nonvolatile memory, or the like, or may be read by the CPU of the computer 1200 via the Internet.

The above embodiment and variations are merely examples and do not limit a scope of the present invention. The scope of the present invention is specified not by the above description but by claims appended with the specification. Accordingly, all modifications are intended to be included within the spirits and the scope of the present invention.

Second Embodiment

Figure 19:
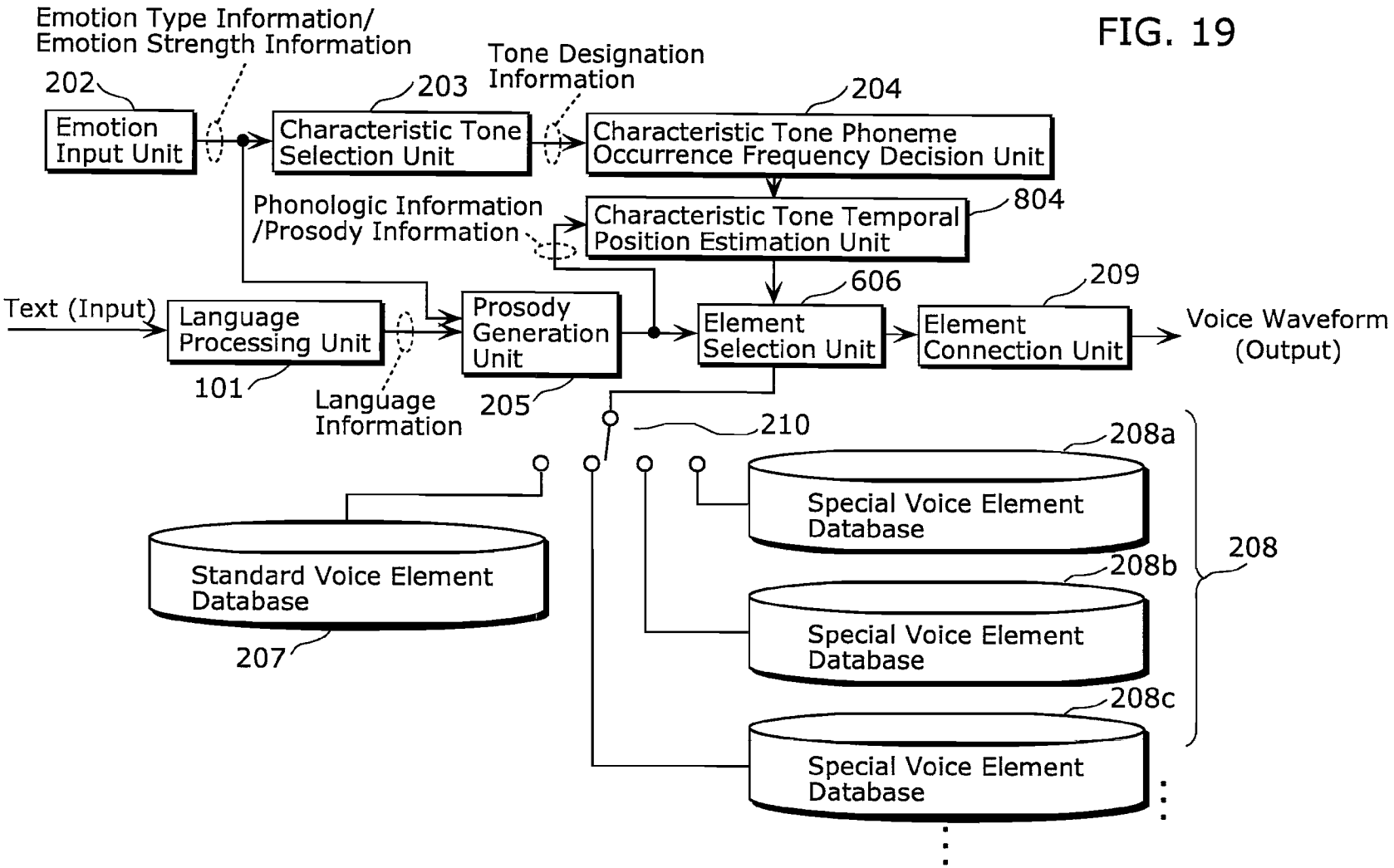
FIG. 19 is a block diagram of a voice synthesis device according to the second embodiment of the present invention.
Figure 20:
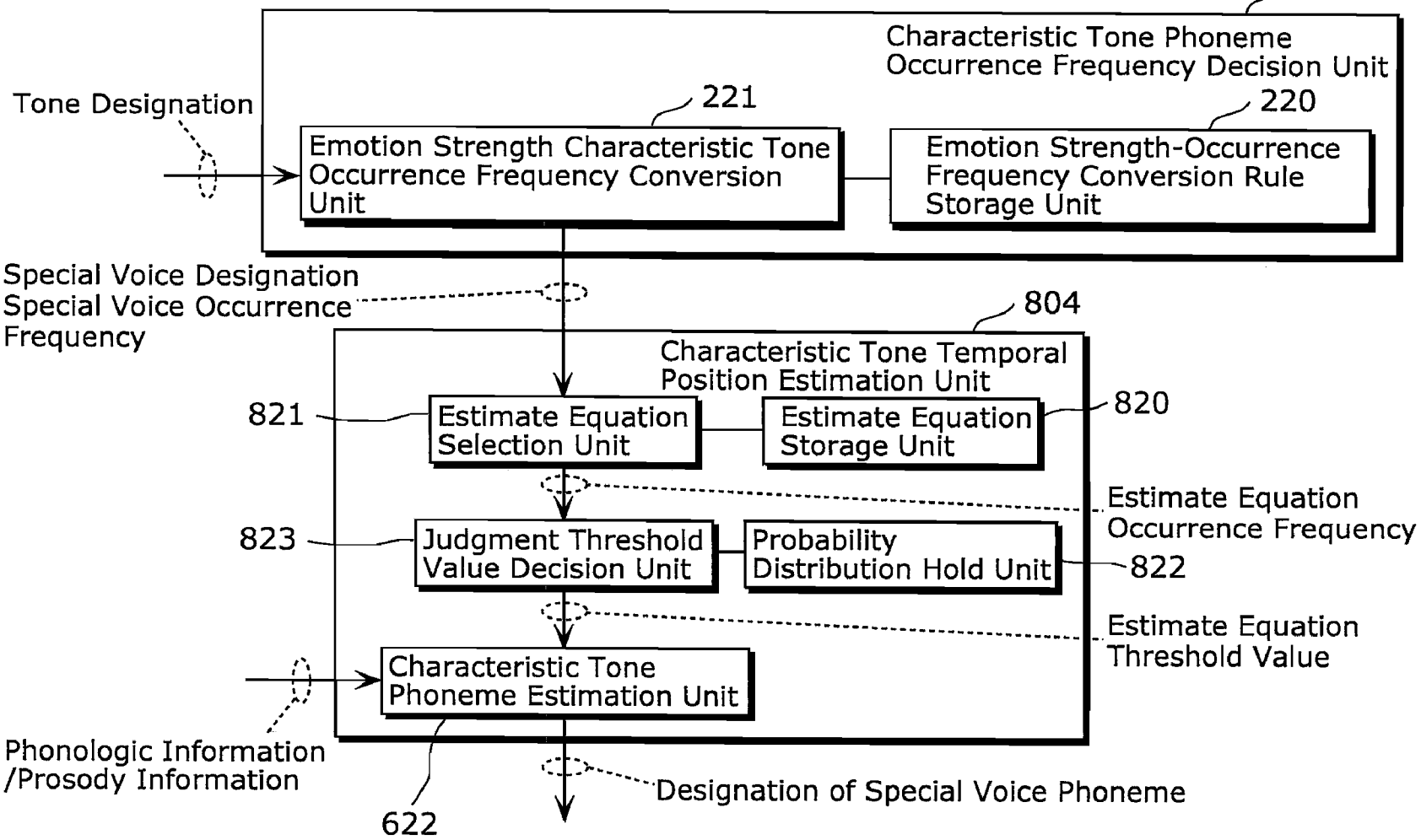
FIG. 20 is a block diagram showing a part of the voice synthesis device according to the second embodiment of the present invention.

FIGS. 19 and 20 are functional block diagrams showing a voice synthesis device according to the second embodiment of the present invention. Note that the reference numerals in FIGS. 4 and 5 are assigned to identical units in FIG. 19 so that the details of those units are same as described above.

As shown in FIG. 19, the voice synthesis device according to the second embodiment includes the emotion input unit 202, the characteristic tone selection unit 203, the language processing unit 101, the prosody generation unit 205, a characteristic tone phoneme occurrence frequency decision unit 204, a characteristic tone temporal position estimation unit 804, the element selection unit 606, the element connection unit 209, the switch 210, the standard voice element database 207, and the special voice element databases 208 (208*a*, 208*b*, 208*c*, . . . ). The structure of FIG. 19 differs from the structure of FIG. 4 in that the characteristic tone temporal position estimation unit 604 is replaced by the characteristic tone phoneme occurrence frequency decision unit 204 and the characteristic tone temporal position estimation unit 804.

The emotion input unit 202 is a processing unit which outputs the emotion type information and an emotion strength. The characteristic tone selection unit 203 is a processing unit which outputs the tone designation information. The language processing unit 101 is a processing unit which outputs the phonologic sequence and the language information. The prosody generation unit 205 is a processing unit which generates the prosody information.

The characteristic tone phoneme occurrence frequency decision unit 204 is a processing unit which obtains the tone designation information, the phonologic sequence, the language information, and the prosody information, and thereby decides a occurrence frequency (generation frequency) of a phoneme in which a special voice is to be generated. The characteristic tone temporal position estimation unit 804 is a processing unit which decides a phoneme in which a special voice is to be generated, according to the occurrence frequency decided by the characteristic tone phoneme occurrence frequency decision unit 204. The element selection unit 606 is a processing unit which (i) selects a voice element from the corresponding special voice element database 208, regarding a phoneme for the designated special voice, and (ii) selects a voice element from the standard voice element database 207, regarding a phoneme for a standard voice. Here, the database from which desired voice elements are selected is chosen by switching the switch 210. The element connection unit 209 is a processing unit which connects the selected voice elements in order to generate a voice waveform.

In other words, the characteristic tone phoneme occurrence frequency decision unit 204 is a processing unit which decides, based on the emotion strength outputted from the emotion input unit 202, how often a phoneme, in which a special voice is to be generated, selected by the characteristic tone selection unit 203 is to be used in a synthesized speech, in other words, an occurrence frequency (generation frequency) of the phoneme in the synthesized speech. As shown in FIG. 20, the characteristic tone phoneme occurrence frequency decision unit 204 includes an emotion strength-occurrence frequency conversion rule storage unit 220 and an emotion strength characteristic tone occurrence frequency conversion unit 221.

The emotion strength-occurrence frequency conversion rule storage unit 220 is a storage device in which strength-occurrence frequency conversion rules are stored. The strength-occurrence frequency conversion rule is used to convert an emotion strength into occurrence frequency (generation frequency) of a special voice. Here, the emotion strength is predetermined for each emotion or feeling to be added to the synthesized speech. The emotion strength-occurrence frequency conversion rule storage unit 221 is a processing unit which selects, from the emotion strength-occurrence frequency conversion rule storage unit 220, a strength-occurrence frequency conversion rule corresponding to the emotion or feeling to be added to the synthesized speech, and then converts an emotion strength into an occurrence frequency (generation frequency) of a special voice based on the selected strength-occurrence frequency conversion rule.

The characteristic tone temporal position estimation unit 804 includes an estimate equation storage unit 820, an estimate equation selection unit 821, a probability distribution hold unit 822, a judgment threshold value decision unit 823, and a characteristic tone phoneme estimation unit 622.

The estimate equation storage unit 820 is a storage device in which estimate equations used for estimation of phonemes in which special voices are to be generated are stored in association with respective kinds of characteristic tones. The estimate equation selection unit 821 is a processing unit which obtains the tone designation information and selects an estimate equation from the estimate equation/threshold value storage unit 620 according to a kind of the tone. The probability distribution hold unit 822 is a storage unit in which a relationship between an occurrence probability of a special voice and a value of the estimate equation is stored as probability distribution, for each kind of characteristic tones. The determination threshold value decision unit 823 is a processing unit which obtains an estimate equation, and decides a threshold value of the estimate equation. Here, the estimate equation is used to judge whether or not a special voice is to be generated. The decision of the threshold value is performed with reference to the probability distribution of the special voice corresponding to the special voice to be generated. The characteristic tone phoneme estimation unit 622 is a processing unit which obtains a phonologic sequence and prosody information, and determines based on the estimate equation and the threshold value whether or not each phoneme is generated as a special voice.

Prior to description for the processing performed by the voice synthesis device having the structure of the second embodiment, description is given for background of decision of an occurrence frequency (generation frequency) of a special voice, more specifically, how the characteristic tone phoneme occurrence frequency decision unit 204 decides an occurrence frequency (generation frequency) of the special voice in the synthesized speech according to a emotion strength. Conventionally, the uniform change in an entire utterance has attracted attention, regarding expression of voice with expression or emotion, especially regarding changes of voice quality. Therefore, the technological developments have been conducted to realize the uniform change. Regarding such voice with expression or emotion, however, it has been known that voices of various voice quality are mixed even in a certain utterance style, thereby characterizing emotion and expression of the voice and giving impression of the voice ("Voice Quality from a viewpoint of Sound Sources", Hideki Kasutani and Nagamori Yo, Journal of The Acoustical Society of Japan, Vol. 51, No. 1, 1995, pp 869-875, for example).

Figure 21:
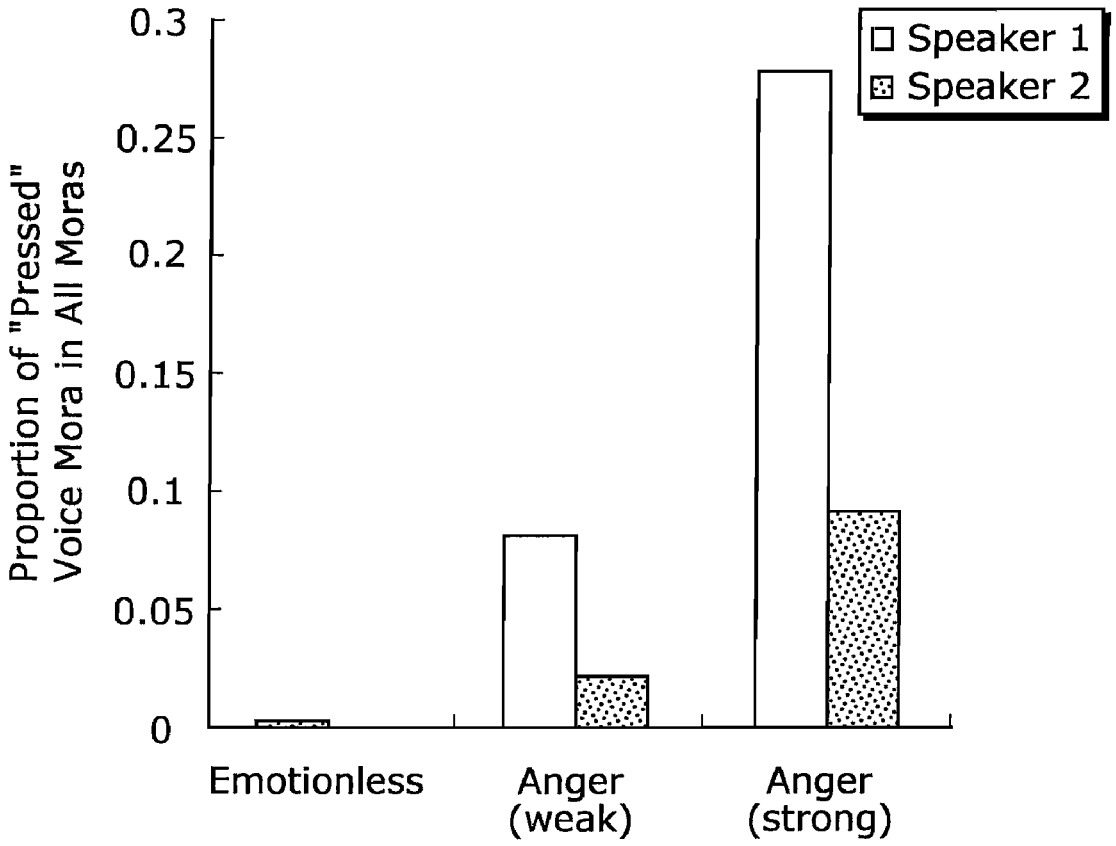
FIG. 21 is a graph showing a relationship between an occurrence frequency of a characteristic-tonal voices and a degree of expression, in an actual speech.

It is assumed that, prior to the execution of the present invention, the research has previously performed for voices without expression, voices with emotion of a medium degree, and voices with emotion of a strong degree, for fifty sentences which have been uttered based on the same text. FIG. 21 shows occurrence frequencies of "pressed voice" sounds in voices with emotion expression "anger" for two speakers. The "pressed voice" sound is similar to a voice which is described as "harsh voice" in the documents described in Background of Invention. Regarding a speaker 1, occurrence frequencies of the "pressed voice" sound (or "harsh voices") are entirely high. Regarding a speaker 2, however, occurrence frequencies of the "pressed voice" sound are entirely low. Although there is differences in occurrence frequencies between the speakers, a tendency of increase of occurrence frequency of "pressed voice" sound in accordance with an emotion strength is the same between the speakers. Regarding the voices with emotion and expression, an occurrence frequency (generation frequency) of characteristic-tonal voice occurred in an utterance is related to a strength of emotion or feeling.

As described previously, FIG. 7A is a graph showing occurrence frequencies of moras which are uttered by the speaker 1 as "pressed" voices with emotion expression "strong anger", for respective consonants in the moras. FIG. 7B is a graph showing occurrence frequencies of moras which are uttered by the speaker 2 as "pressed" voices with emotion expression "strong anger", for respective consonants in the moras. Likewise, FIG. 7C is a graph showing, for respective consonants, occurrence frequencies of moras which are uttered by the speaker 1 as "pressed" voices with emotion expression "medium anger". FIG. 7D is a graph showing, for respective consonants, occurrence frequencies of moras which are uttered by the speaker 2 as "pressed" voices with emotion expression "medium anger".

As described in the first embodiment, from the graphs of FIGS. 7A and 7B, it is understood that there is a common tendency of the occurrence frequencies between the speakers 1 and 2, since the occurrence frequencies are high when the "pressed" voice is a voice with consonant "t", "k", "d", "m", or "n", or a voice without any consonant, and the occurrence frequencies are low when the "pressed" voice is a voice with a consonant "p", "ch", "ts", or "f". In addition, between voices with emotion expression "strong anger" and voices with emotion expression "medium anger", it is apparent, from comparison between the graphs of FIGS. 7A and 7C and comparison between the graphs of FIGS. 7B and 7D, that the bias tendency of occurrence for kinds of consonants are not changed, but the occurrence frequencies are changed depending on the emotion strength. Note that the bias tendency means that the occurrence frequencies are high when the "pressed" voice is a voice with consonant "t", "k", "d", "m", or "n", or a voice without any consonant, and that the occurrence frequencies are low when the "pressed" voice is a voice with a consonant "p", "ch", "ts", or "f". Here, although the bias tendency is not changed even if the emotion strength varies, both of the speakers 1 and 2 have the same feature where occurrence frequencies are varied in the entire special voices depending on degrees of emotion strength. Therefore, in order to control the emotion strength and expression to add more natural emotion or feeling into a synthesized speech, it is necessary to generate a voice having a characteristic tone at a more appropriate part of an utterance, and also to generate the voice having a characteristic tone by an appropriate occurrence frequency.

It has been described in the first embodiment that an occurrence position of a special voice in a phonologic sequence of a synthesized speech can be estimated based on information such as a kind of a phoneme, since there is the common tendency in the occurrence of characteristic tone among speakers. In addition, it is understood that the tendency in the occurrence of characteristic tone is not changed even if emotion strength varies, but the entire occurrence frequency is changed depending on strength of emotion or feeling. Accordingly, by setting occurrence frequencies of special voices corresponding to strength of emotion or feeling of a voice to be synthesized, it is possible to estimate an occurrence position of a special voice in voices so that the occurrence frequencies can be realized.

Figure 22:
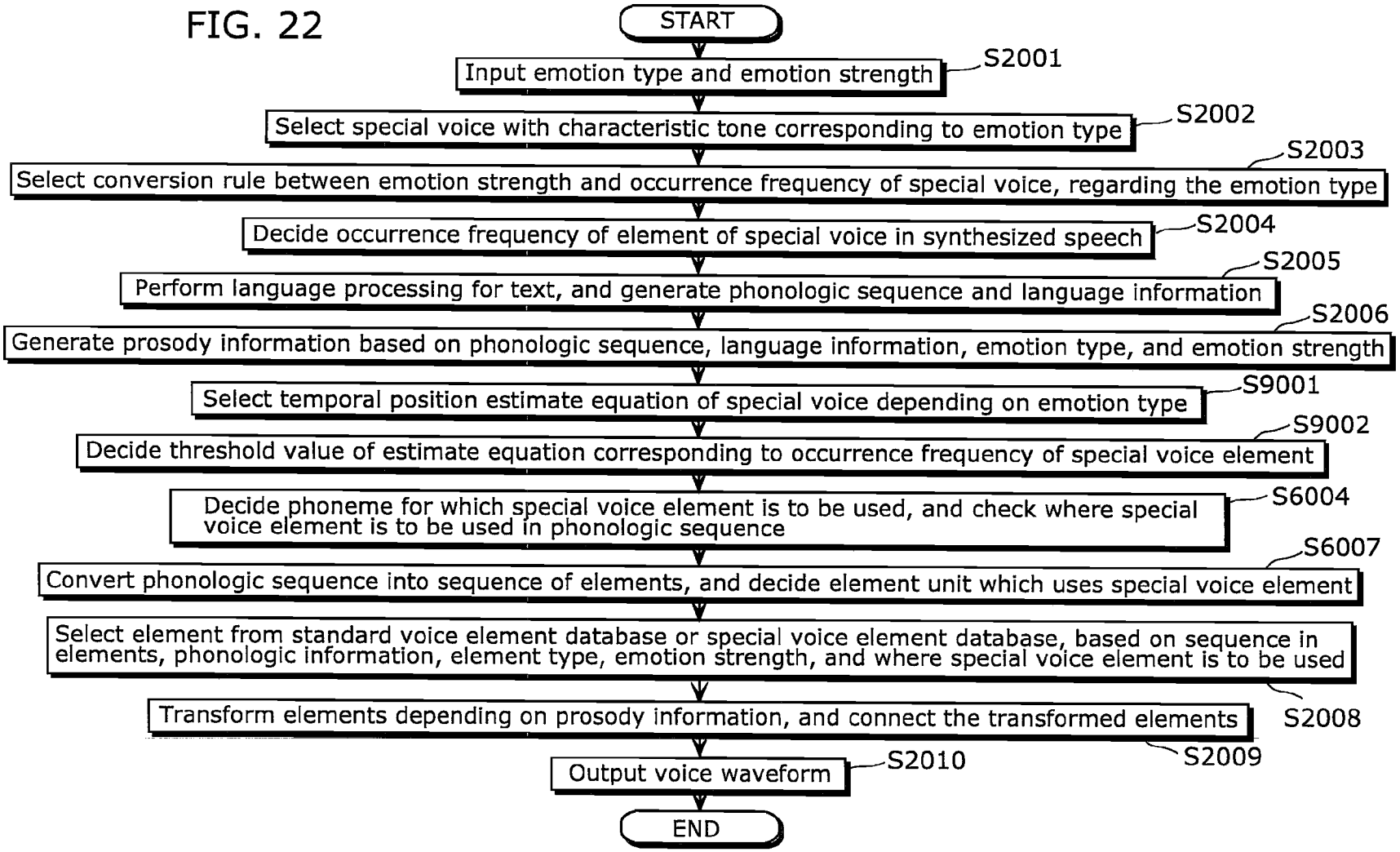
FIG. 22 is a flowchart showing processing performed by the voice synthesis device according to the second embodiment of the present invention.

Next, the processing performed by the voice synthesis device is described with reference to FIG. 22. Note that the step numerals in FIG. 9 are assigned to identical steps in FIG. 22 so that the details of those steps are same as described above.

Firstly, "anger 3", for example, is inputted as the emotion control information into the emotion input unit 202, and the emotion type "anger" and emotion strength "3" are extracted from the "anger 3" (S2001). For example, the emotion strength is represented by five degrees: 0 denotes a voice without expression, 1 denotes a voice with slight emotion or feeling, 5 denotes a voice with strongest expression among usually observed voice expression, and the like, where the larger value denotes the stronger emotion or feeling.

Based on an emotion type "anger" and an emotion strength (emotion strength information "3") which are outputted from the emotion input unit 202, the characteristic tone selection unit 203 selects a "pressed" voice occurred in voices with "anger", as a characteristic tone (S2002).

Figure 23:
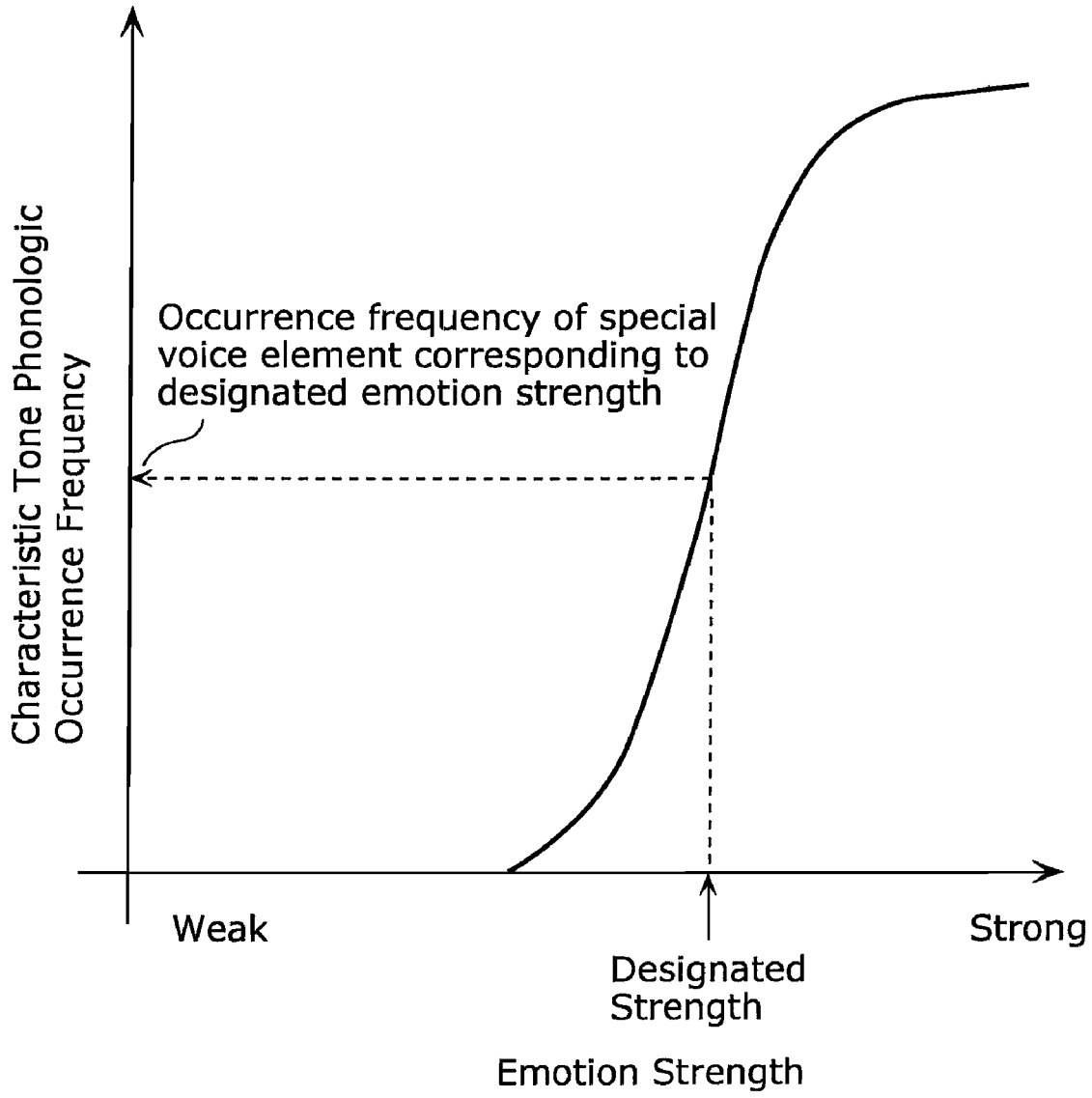
FIG. 23 is a graph showing a relationship between an occurrence frequency of a characteristic-tonal voices and a degree of expression, in an actual speech.

Next, the emotion strength characteristic tone occurrence frequency conversion unit 221 obtains an emotion strength-occurrence frequency conversion rule from the emotion strength-occurrence frequency conversion rule storage unit 220 based on the tone designation information for designating "pressed" voice and emotion strength information "3". The emotion strength-occurrence frequency conversion rules are set for respective designated characteristic tones. In this case, a conversion rule for a "pressed" voice expressing "anger" is obtained. The conversion rule is a function showing a relationship between an occurrence frequency of a special voice and a strength of emotion or feeling, as shown in FIG. 23. The function is created by collecting voices of various strengths for each emotion or feeling, and learning a relationship between (i) an occurrence of a phoneme of a characteristic tone observed in voices and (ii) a strength of emotion or feeling of the voice, using statistical models. Although the conversion rules are described to be designated as functions, the conversion rules may be stored as a table in which an occurrence frequency and a degree of strength are stored in association with each other.

The emotion strength characteristic tone occurrence frequency conversion unit 221 applies the designated emotion strength into the conversion rule as shown in FIG. 23, and thereby decides an occurrence frequency (use frequency) of a special voice element in the synthesized speech (hereinafter, referred to as "special voice occurrence frequency"), according to the designated emotion strength (S2004). On the other hand, the language processing unit 101 analyzes morphemes and syntax of an input text, and outputs a phonologic sequence and language information (S2005). The prosody generation unit 205 obtains the phonologic sequence, the language information, and also emotion type information, and thereby generates prosody information (S2006).

The estimate equation selection unit 821 obtains the special voice designation and the special voice occurrence frequency, and obtains an estimate equation corresponding to the special voice "Pressed Voice" from the estimate equations which are stored in the estimate equation storage unit 820 for respective special voices (S9001). The judgment threshold value decision unit 823 obtains the estimate equation and the occurrence frequency information, then obtains from the probability distribution hold unit 822 a probability distribution of the estimate equation corresponding to the designated special voice, and eventually decide a judgment threshold value corresponding to the estimate equation of the occurrence frequency of the special voice element decided at step S2004 (S9002).

Figure 24:
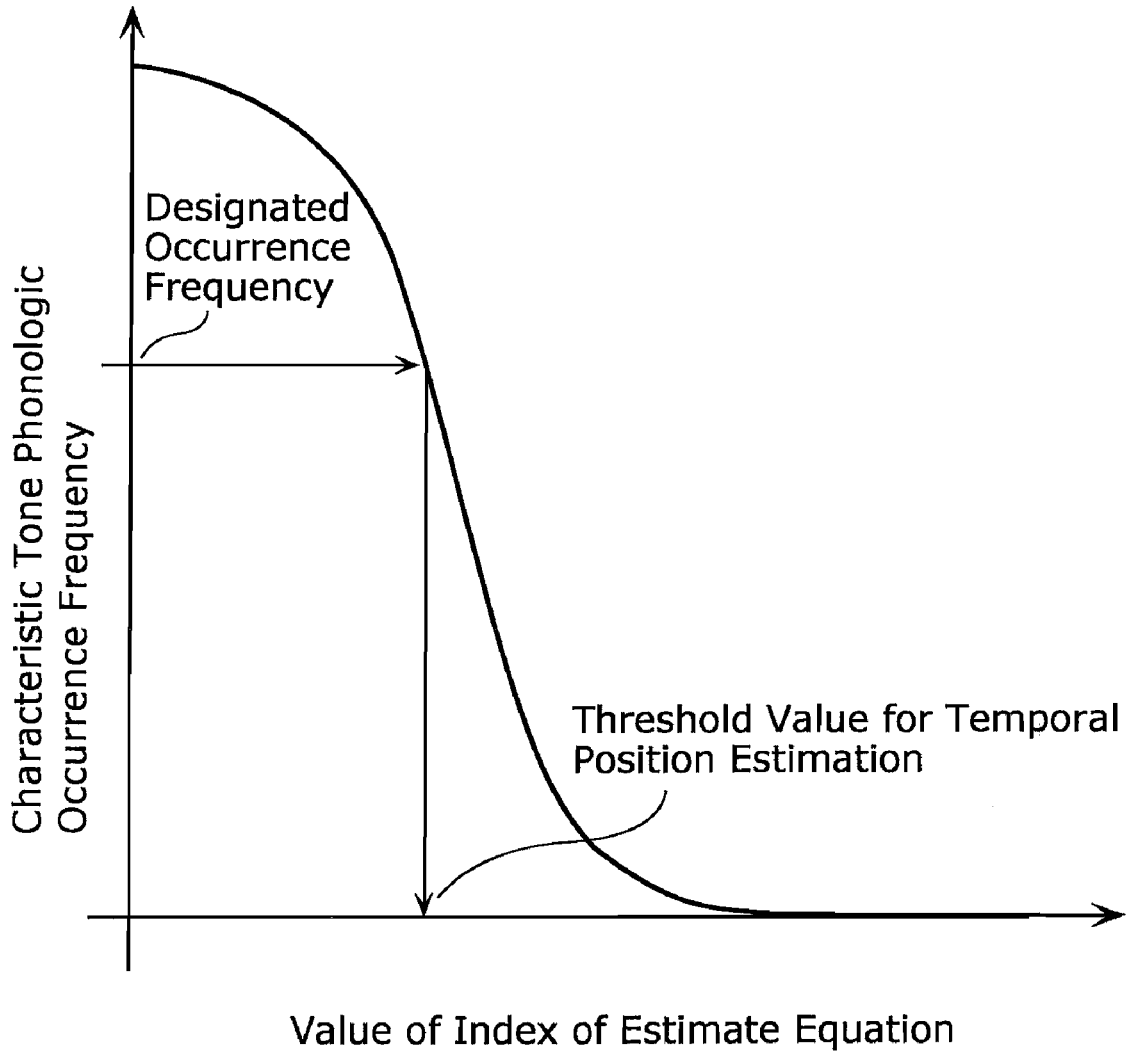
FIG. 24 is a graph showing a relationship between an occurrence frequency of a phoneme of a characteristic tone and a value of an estimate equation.

The probability information is set, for example, as described below. If the estimate equation is Quantification Method II as described in the first embodiment, a value of the estimate equation is uniquely decided based on attributes such as kinds of a consonant and a vowel, and a position of a mora within an accent phrase regarding a target phoneme. This value shows ease of occurrence of the special voice in a target phoneme. As previously described with reference to FIGS. 7A to 7D, and FIG. 21, a tendency of ease of occurrence of a special voice is not changed for a speaker, or a strength of emotion or feeling. Thereby, it is not necessary to change the estimate equation of Quantification Method II depending on a strength of emotion or feeling. Moreover, from the same estimate equation it is possible to know "ease of occurrence of a special voice" of each phoneme, even if the strength varies. Therefore, an estimate equation created from voice data with an emotion strength "5" is applied to other voice data with emotion strengths "4", "3", "2", and "1", respectively, in order to calculate, for respective voice with the various strengths, values of the estimate equation as judgment threshold values whose accurate rate becomes 75% of an actually observed special voices. As shown in FIG. 21, since an occurrence frequency of a special voice is varied depending on a strength of emotion or feeling, a probability distribution is able to set as described below. First, characteristic tone phoneme occurrence frequencies and values of index of estimate equation are plotted as axes of a graph of FIG. 24. The characteristic tone phoneme occurrence frequencies are occurrence frequencies of a special phoneme observed in voice data with respective strengths, in other words, respective voice data with strengths of anger "4", "3", "2", and "1". The values of index of estimate equation are values of estimate equation by which occurrence of the special voices are able to be judged with accuracy rate 75%. The plotting is a smooth line using spline interpolation or approximation to a sigmoid curve, or the like. Note that the probability distribution is not limited to the function as shown in FIG. 24, but may be stored as a table in which the characteristic tone phoneme occurrence frequencies and the values of the estimate equation are stored in association with each other.

The characteristic tone phoneme estimation unit 622 obtains the phonologic sequence generated at step S2005 and the prosody information generated at step S2006. Then, the characteristic tone phoneme estimation unit 622 calculates a value by applying the estimate equation selected at step S9001 to each phoneme in the phonologic sequence, and then compares the calculated value with the threshold value selected at step S9002. If the calculated value exceeds the threshold value, the characteristic tone phoneme estimation unit 622 decides that the phoneme is to be uttered as a special voice (S6004).

The element selection unit 606 obtains the phonologic sequence and the prosody information from the prosody generation unit 205, and further obtains the special voice phoneme information decided by the characteristic tone phoneme estimation unit 622 at step S6004. The element selection unit 606 applies these information into the phonologic sequence to be synthesized, then converts the phonologic sequence (sequence of phonemes) into a sequence of elements, and eventually decides an element unit which uses special voice elements (S6007). Furthermore, depending on elements positions using the decided special voice element and element positions without the decided special voice elements, the element selection unit 606 selects voice elements necessary for the synthesis, by switching the standard voice element database 207, and one of the special voice element databases 208*a*, 208*b*, 208*c*, . . . in which the special voice elements of the designated kind are stored (S2008). Using a waveform superposition method, the element connection unit 209 transforms and connects the elements selected at Step S2008 based on the obtained prosody information (S2009), and outputs a voice waveform (S2010). Note that it has been described to connect the elements using the waveform superposition method at step S2008, it is also possible to connect the elements using other methods.

With the above structure, the voice synthesis device according to the second embodiment is characterized in including: the emotion input unit 202 which receives an emotion type and an emotion strength as an input; the characteristic tone selection unit 203 which selects a kind of a characteristic tone corresponding to the emotion type and the emotion strength; the characteristic tone phoneme occurrence frequency decision unit 204; the characteristic tone temporal position estimation unit 804 which decides a phoneme, in which a special voice is to be generated, according to the designated occurrence frequency, and includes the estimate equation storage unit 820, the estimate equation selection unit 821, the probability distribution hold unit 822, the judgment threshold value decision unit 823; and the standard voice element database 207 and the special voice element databases 208*a*, 208*b*, 208*c*, . . . , in which elements of voices that characteristic to voices with emotion are stored for each characteristic tone.

With the above structure, in the voice synthesis device according to the second embodiment, occurrence frequencies (generation frequencies) of characteristic-tonal voices occurred at parts of an utterance of voices with emotion are decided. Then, depending on the decided occurrence frequencies (generation frequencies), respective temporal positions at which the characteristic-tonal voices are to be generated are estimated per phoneme such as moras, syllables, or phonemes, using the phonologic sequence, the prosody information, the language information, and the like. Thereby, it is possible to generate a synthesized speech which reproduces various quality voices for expressing emotion, expression, an utterance style, human relationship, and the like in the utterance.

Furthermore, according to the voice synthesis device of the second embodiment, it is possible to imitate, with accuracy of phoneme positions, behavior which appears naturally and generally in human utterances in order to express emotion, expression, and the like by using characteristic tone, not by changing voice quality and phonemes. Therefore, it is possible to provide the voice synthesis device having a high expression ability so that types and kinds of emotion and expression are intuitively perceived as natural.

It has been described in the second embodiment that the voice synthesis device has the element selection unit 606, the standard voice element database 207, the special voice element databases 208, and the element connection unit 209, in order to realize voice synthesis by the voice synthesis method using a waveform superposition method. Instead of those units, however, a voice synthesis device according to another variation of the second embodiment may have, in the same manner as described in the first embodiment with reference to FIG. 12: the element selection unit 706 which selects a parameter element; the standard voice parameter element database 307; the special voice conversion rule storage unit 308; the parameter transformation unit 309; and the waveform generation unit 310, in order to realize voice synthesis.

It has been described in the second embodiment that the voice synthesis device has the element selection unit 606, the standard voice element database 207, the special voice element databases 208, and the element connection unit 209, in order to realize voice synthesis by the voice synthesis method using a waveform superposition method. Instead of these units, however, the voice synthesis device according to still another variation of the second embodiment may have, in the same manner as described in the first embodiment with reference to FIG. 14: the synthesized-parameter generation unit 406; the special voice conversion rule storage unit 308; the parameter transformation unit 309; and the waveform generation unit 310. The synthesized-parameter generation unit 406 generates a parameter sequence of standard voices. The parameter transformation unit 309 generates a special voice from a standard voice parameter according to a conversion rule and realizes a voice of a desired phoneme.

It has been described in the second embodiment that the voice synthesis device has the element selection unit 606, the standard voice element database 207, the special voice element databases 208, and the element connection unit 209, in order to realize voice synthesis by the voice synthesis method using a waveform superposition method. Instead of those units, however, the voice synthesis device according to still another variation of the second embodiment may have, in the same manner as described in the first embodiment with reference to FIG. 16: the standard voice parameter generation unit 507; one or more special voice parameter generation units 508 (508*a*, 508*b*, 508*c*, . . . ,); the switch 809; and the waveform generation unit 310. The standard voice parameter generation unit 507 generates a parameter sequence of standard voices. Each of the special voice parameter generation units 508 generates a parameter sequence of a characteristic-tonal voice (special voice). The switch 809 is used to switch between the standard voice parameter generation unit 507 and the special voice parameter generation units 508. The waveform generation unit 310 generates a voice waveform from a synthesized parameter sequence.

Note that it has been described in the second embodiment that the probability distribution hold unit 822 holds the probability distribution which indicates relationships between occurrence frequencies of characteristic tone phonemes and values of estimate equations. However, it is also possible to hold the relationships not only as the probability distribution, but also as a table in which the relationships are stored.

Third Embodiment

Figure 25:
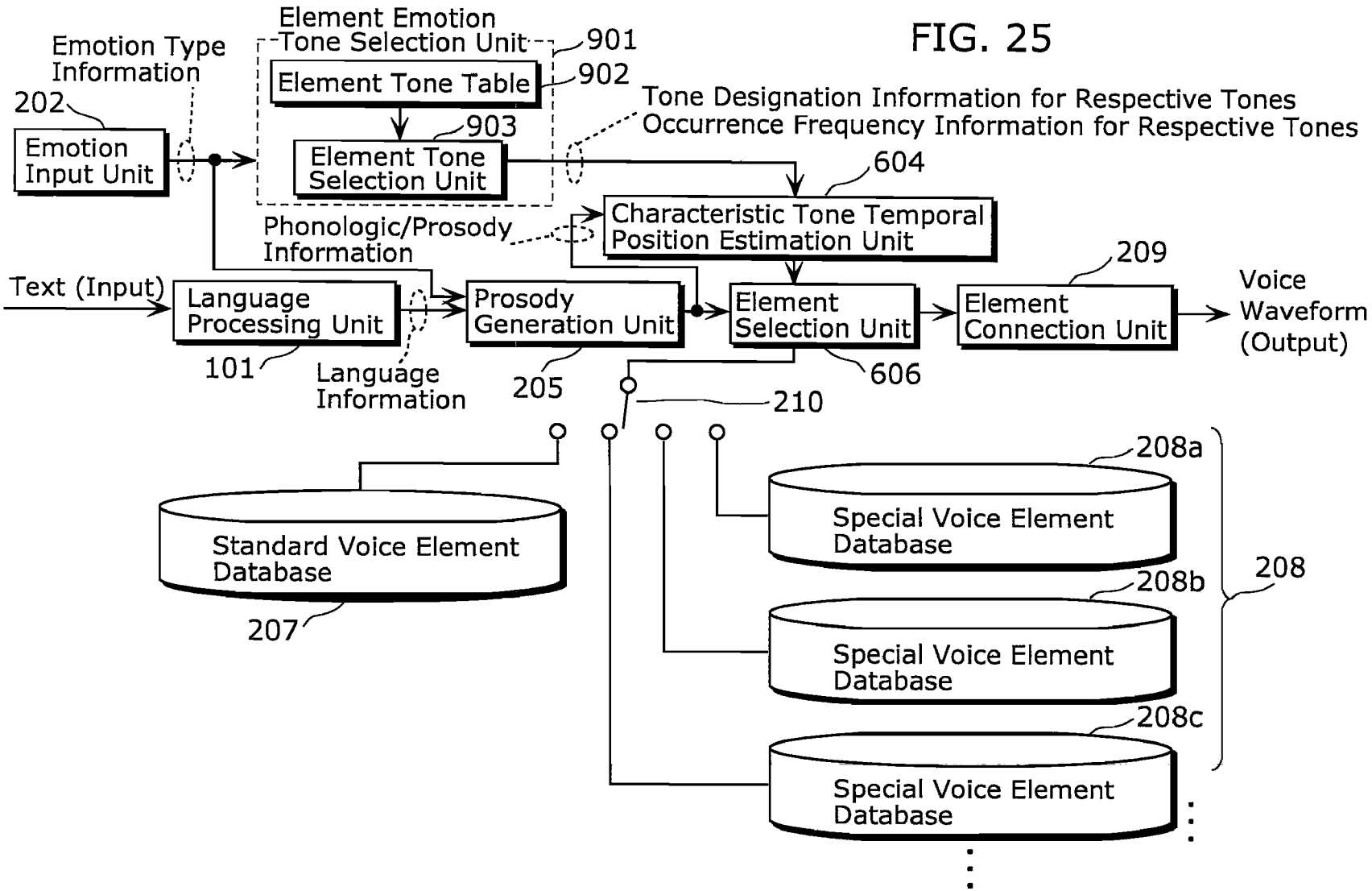
FIG. 25 is a flowchart showing processing performed by the voice synthesis device according to the third embodiment of the present invention.

FIG. 25 is a functional block diagram showing a voice synthesis device according to the third embodiment of the present invention. Note that the reference numerals in FIGS. 4 and 19 are assigned to identical units in FIG. 25 so that the details of those units are same as described above.

As shown in FIG. 25, the voice synthesis device according to the third embodiment includes the emotion input unit 202, an element emotion tone selection unit 901, the language processing unit 101, the prosody generation unit 205, the characteristic tone temporal position estimation unit 604, the element selection unit 606, the element connection unit 209, the switch 210, the standard voice element database 207, and the special voice element databases 208 (208*a*, 208*b*, 208*c*, . . . ). The structure of FIG. 25 differs from the voice synthesis device of FIG. 4 in that the characteristic tone selection unit 203 is replaced by the element emotion tone selection unit 901.

The emotion input unit 202 is a processing unit which outputs emotion type information. The element emotion tone selection unit 901 is a processing unit which decides (i) one or more kinds of characteristic tones which are included in input voices expressing emotion (hereinafter, referred to as "tone designation information for respective tones") and (ii) respective occurrence frequencies (generation frequencies) of the kinds in the synthesized speech (hereinafter, referred to as "occurrence frequency information for respective tones"). The language processing unit 101 is a processing unit which outputs a phonologic sequence and language information. The prosody generation unit 205 is a processing unit which generates prosody information. The characteristic tone temporal position estimation unit 604 is a processing unit which obtains the tone designation information for respective tones, the occurrence frequency information for respective tones, the phonologic sequence, the language information, and the prosody information, and thereby determines a phoneme, in which a special voice is to be generated, for each kind of special voices, according to the occurrence frequency of each characteristic tone generated by the element emotion tone selection unit 901.

The element selection unit 606 is a processing unit which (i) selects a voice element from the corresponding special voice element database 208, regarding a phoneme for the designated special voice, and (ii) selects a voice element from the standard voice element database 207, regarding a phoneme for other voice (standard voice). Here, the database from which desired voice elements are selected is chosen by switching the switch 210. The element connection unit 209 is a processing unit which connects the selected voice elements in order to generate a voice waveform.

The element emotion tone selection unit 901 includes an element tone table 902 and an element tone selection unit 903.

As shown in FIG. 26, in the element tone table 902, a group of (i) one or more kinds of characteristic tones included in input voices expressing emotion and (ii) respective occurrence frequencies of the kinds are stored. The element tone selection unit 903 is a processing unit which decides, from the element tone table 902, (i) one or more kinds of characteristic tones included in voices and (ii) occurrence frequencies of the kinds, according to the emotion type information obtained by the emotion input unit 202.

Figure 27:
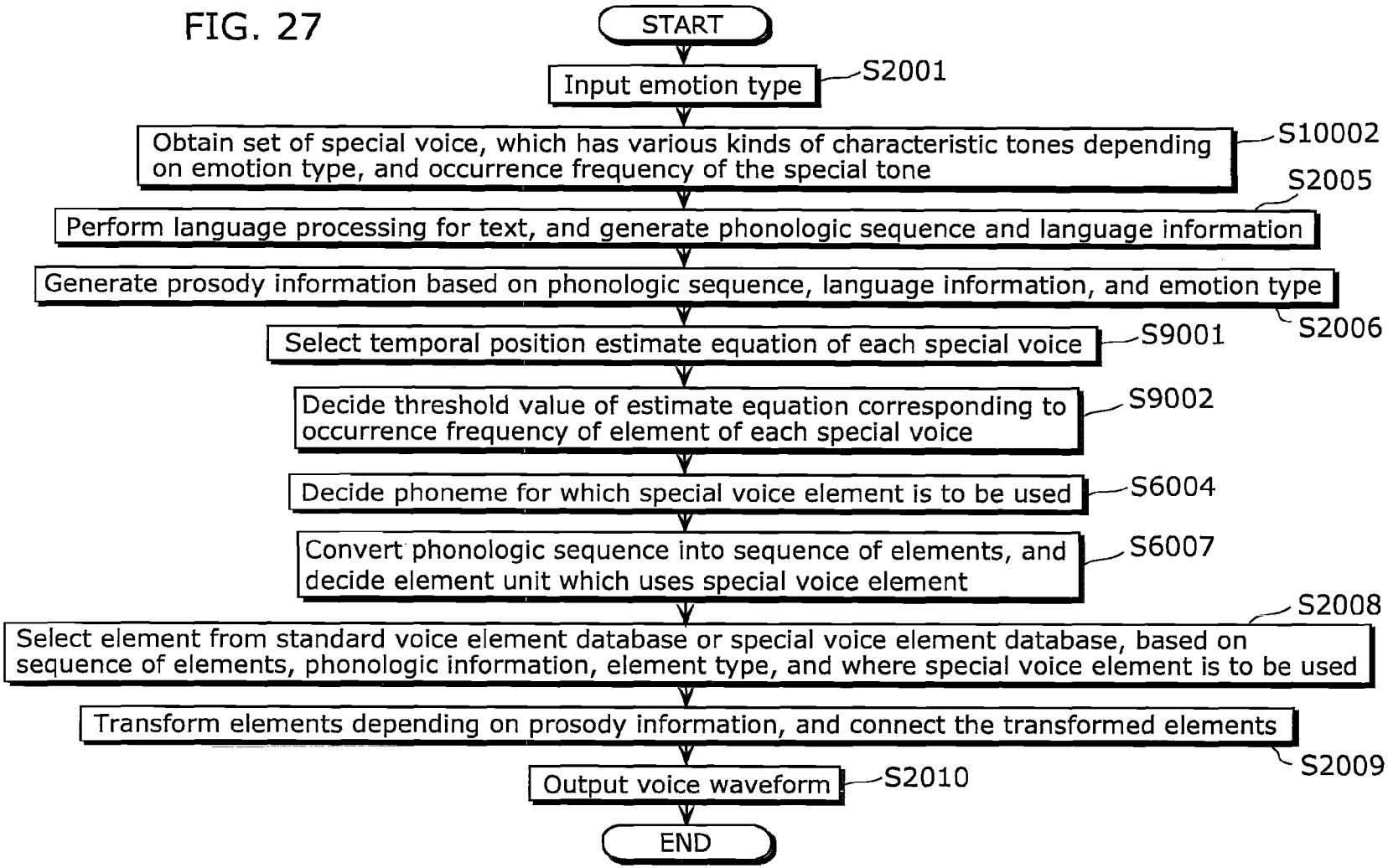
FIG. 27 is a flowchart showing processing performed by the voice synthesis device according to the third embodiment of the present invention.

Next, the processing performed by the voice synthesis device according to the third embodiment is described with reference to FIG. 27. Note that the step numerals in FIGS. 9 and 22 are assigned to identical steps in FIG. 27 so that the details of those steps are same as described above.

First, emotion control information is inputted to the emotion input unit 202, and an emotion type (emotion type information) is extracted from the emotion control information (S2001). The element tone selection unit 903 obtains the extracted emotion type, and obtained, from the element tone table 902, data of a group of (i) one or more kinds of characteristic tones (special phonemes) corresponding to the emotion type and (ii) occurrence frequencies (generation frequencies) of the respective characteristic tones in the synthesized speech, and then outputs the obtained group data (S10002).

On the other hand, the language processing unit 101 analyzes morphemes and syntax of an input text, and outputs a phonologic sequence and language information (S2005). The prosody generation unit 205 obtains the phonologic sequence, the language information, and also the emotion type information, and thereby generates prosody information (S2006).

The characteristic tone temporal position estimation unit 604 selects respective estimate equations corresponding to the respective designated characteristic tones (special voices) (S9001), and decides respective judgment threshold values corresponding to respective values of the estimate equations, depending on the respective occurrence frequencies of the designated special voices (S9002). The characteristic tone temporal position estimation unit 604 obtains the phonologic information generated at step S2005 and the prosody information generated at step S2006, and further obtains the estimate equations selected at step S9001 and the threshold values decided at step S9002. Using the above information, the characteristic tone temporal position estimation unit 604 decides phonemes in which special voices are to be generated, and checks where the decided special voice elements are to be used in the phonologic sequence (S6004). The element selection unit 606 obtains the phonologic sequence and the prosody information from the prosody generation unit 205, and further obtains the special voice phoneme information decided by the characteristic tone phoneme estimation unit 622 at step S6004. The element selection unit 606 applies these information into the phonologic sequence to be synthesized, then converts the phonologic sequence (sequence of phonemes) into a sequence of elements, and eventually decides where the special voice elements are to be used in the sequence (S6007).

Furthermore, depending whether element positions of the special voice elements decided at step S6007 and element positions without the decided special voice elements, the element selection unit 606 selects voice elements necessary for the synthesis, by switching the standard voice element database 207, and one of the special voice element databases 208*a*, 208*b*, 208*c*, . . . in which the special voice elements of the designated kinds are stored (S2008). Using a waveform superposition method, the element connection unit 209 transforms and connects the elements selected at Step S2008 based on the obtained prosody information (S2009), and outputs a voice waveform (S2010). Note that it has been described to connect the elements using the waveform superposition method at step S2008, it is also possible to connect the elements using other methods.

Figure 28:
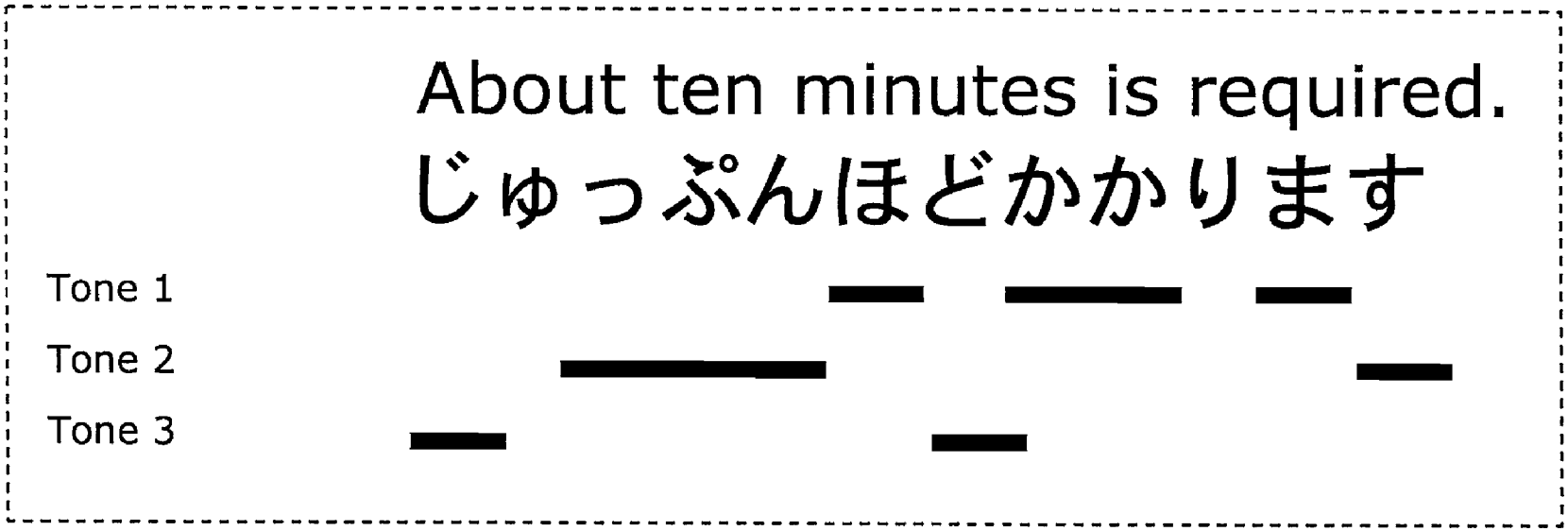
FIG. 28 is a diagram showing one example of positions of special voices when voices are synthesized.

FIG. 28 is a diagram showing one example of special voices when voices (utterance) "About ten minutes is required." are synthesized by the above processing. More specifically, positions for special voice elements are decided so that three kinds of characteristic tones are not mixed.

With the above structure, the voice synthesis device according to the third embodiment includes: the emotion input unit 202 which receives an emotion type as an input; the element emotion tone selection unit 901 which generates, for the emotion type, (i) one or more kinds of characteristic tones and (ii) occurrence frequencies of the respective characteristic tones, according to one or more kinds of characteristic tones and occurrence frequencies which are predetermined for the respective characteristic tone types; the characteristic tone temporal position estimation unit 604; and the standard voice element database 207 and the special voice element databases 208 in which elements of voices characterized for voices with emotion are stored for each characteristic tone.

With the above structure, in the voice synthesis device according to the third embodiment, phonemes, in which special voice are to be generated and which are a plurality of kinds of characteristic tones that appear at parts of voices of an utterance with emotion, are decided depending on an input emotion type. Furthermore, occurrence frequencies (generation frequencies) for the respective phonemes in which special voices are to be generated are decided. Then, depending on the decided occurrence frequencies (generation frequencies), respective temporal positions at which the characteristic-tonal voices are to be generated are estimated per unit of phoneme, such as a mora, syllable, or a phoneme, using the phonologic sequence, the prosody information, the language information, and the like. Thereby, it is possible to generate a synthesized speech which reproduces various quality voices for expressing emotion, expression, an utterance style, human relationship, and the like in the utterance.

Furthermore, according to the voice synthesis device of the third embodiment, it is possible to imitate, with accuracy of phoneme positions, behavior which appears naturally and generally in human utterances in order to "express emotion, expression, and the like by using characteristic tone", not by changing voice quality and phonemes. Therefore, it is possible to provide the voice synthesis device having a high expression ability so that types and kinds of emotion and expression are intuitively perceived as natural.

It has been described in the third embodiment that the voice synthesis device has the element selection unit 606, the standard voice element database 207, the special voice element databases 208, and the element connection unit 209, in order to realize voice synthesis by the voice synthesis method using a waveform superposition method. Instead of those units, however, a voice synthesis device according to another variation of the third embodiment may have, in the same manner as described in the first and second embodiments with reference to FIG. 12: the element selection unit 706 which selects a parameter element; the standard voice parameter element database 307; the special voice conversion rule storage unit 308; the parameter transformation unit 309; and the waveform generation unit 310, in order to realize voice synthesis.

It has been described in the third embodiment that the voice synthesis device has the element selection unit 606, the standard voice element database 207, the special voice element databases 208, and the element connection unit 209, in order to realize voice synthesis by the voice synthesis method using a waveform superposition method. Instead of these units, however, the voice synthesis device according to still another variation of the third embodiment may have, in the same manner as described in the first and second embodiments with reference to FIG. 14: the synthesized-parameter generation unit 406; the special voice conversion rule storage unit 308; the parameter transformation unit 309; and the waveform generation unit 310. The synthesized-parameter generation unit 406 generates a parameter sequence of standard voices. The parameter transformation unit 309 generates a special voice from a standard voice parameter according to a conversion rule and realizes a voice of a desired phoneme.

It has been described in the third embodiment that the voice synthesis device has the element selection unit 606, the standard voice element database 207, the special voice element databases 208, and the element connection unit 209, in order to realize voice synthesis by the voice synthesis method using a waveform superposition method. Instead of those units, however, the voice synthesis device according to still another variation of the third embodiment may have, in the same manner as described in the first and second embodiments with reference to FIG. 16: the standard voice parameter generation unit 507; one or more special voice parameter generation units 508 (508*a*, 508*b*, 508*c*, . . . ,); the switch 809; and the waveform generation unit 310. The standard voice parameter generation unit 507 generates a parameter sequence of standard voices. Each of the special voice parameter generation units 508 generates a parameter sequence of a characteristic-tonal voice (special voice). The switch 809 is used to switch between the standard voice parameter generation unit 507 and the special voice parameter generation units 508. The waveform generation unit 310 generates a voice waveform from a synthesized parameter sequence.

Note that it has been described in the third embodiment that the probability distribution hold unit 822 holds the probability distribution which indicates relationships between occurrence frequencies of characteristic tone phonemes and values of estimate equations. However, it is also possible to hold the relationships not only as the probability distribution, but also as a table in which the relationships are stored.

Note also that it has been described in the third embodiment that the emotion input unit 202 receives input of emotion type information and that the element tone selection unit 903 selects one or more kinds of characteristic tones and occurrence frequencies of the kinds which are stored for each emotion type in the element tone table 902, according to only the emotion type information. However, the element tone table 902 may store, for each emotion type and emotion strength, such a group of characteristic tone kinds and occurrence frequencies of the characteristic tone kinds. Moreover, the element tone table 902 may store, for each emotion type, a table or a function which indicates a relationship between (i) a group of characteristic tone kinds and (ii) changes of occurrence frequencies of the respective characteristic tones depending on the emotion strength. Then, the emotion input unit 202 may receive the emotion type information and the emotion strength information, and the element tone selection unit 903 may decide characteristic tone kinds and occurrence frequencies of the kinds from the element tone table 902, according to the emotion type information and the emotion strength information.

Note also that it has been described in the first to third embodiments and their variations that, immediately prior to step S2003, S6003, or S9001, the language processing for texts is performed by the language processing unit 101, and the processing for generating a phonologic sequence and language information (S2005) and processing for generating prosody information from a phonologic sequence, language information, and emotion type information (or emotion type information and emotion strength information) by the prosody generation unit 205 (S2006) are performed. However, the above processing may be performed anytime prior to the processing for deciding a position at which a special voice is to be generated in a phonologic sequence (S2007, S3007, S3008, S5008, or S6004).

Figure 29:
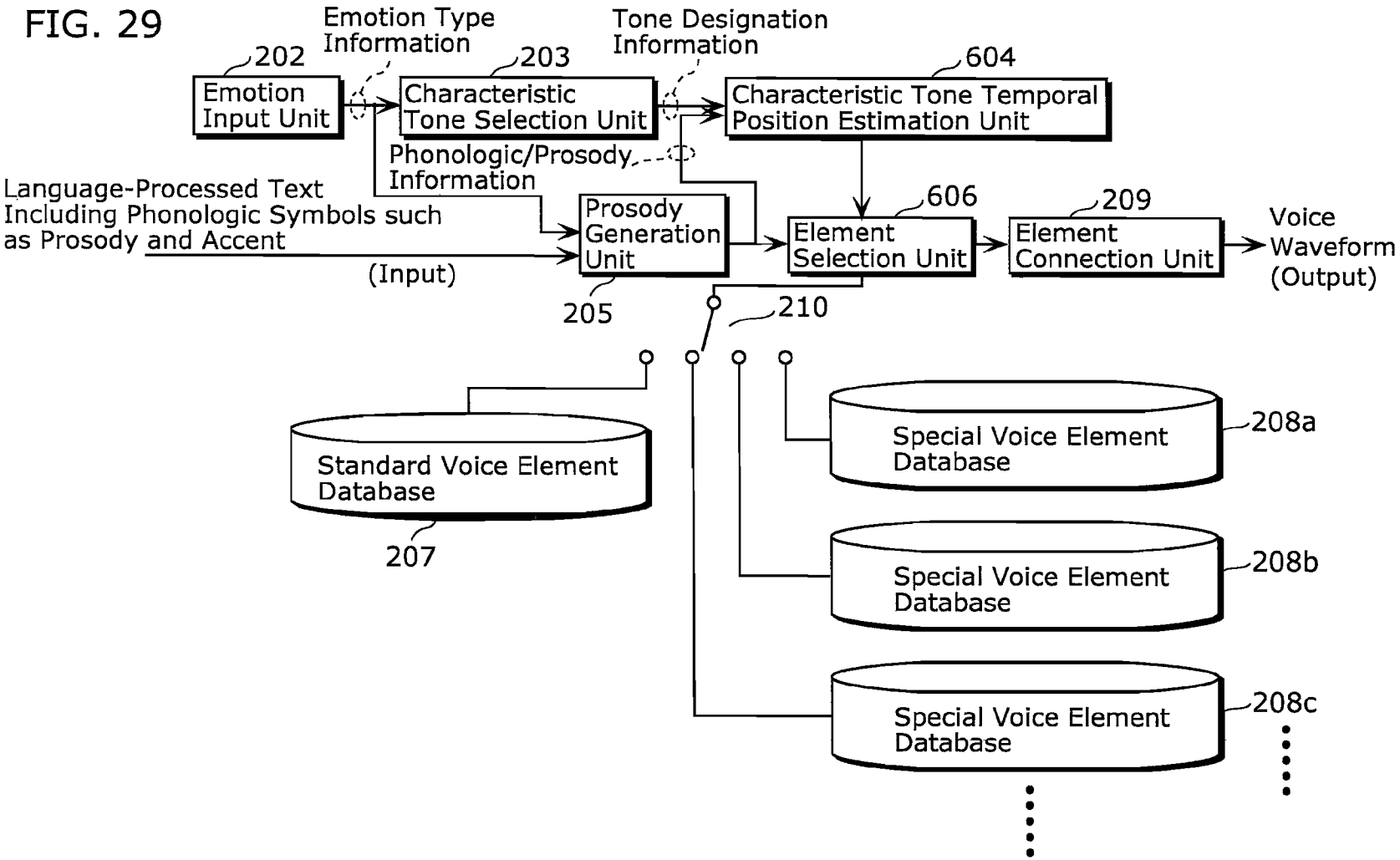
FIG. 29 is a block diagram showing a voice synthesis device according to still another variation of the first embodiment of the present invention, in other words, showing a variation of the voice synthesis device of FIG. 4.
Figure 30:
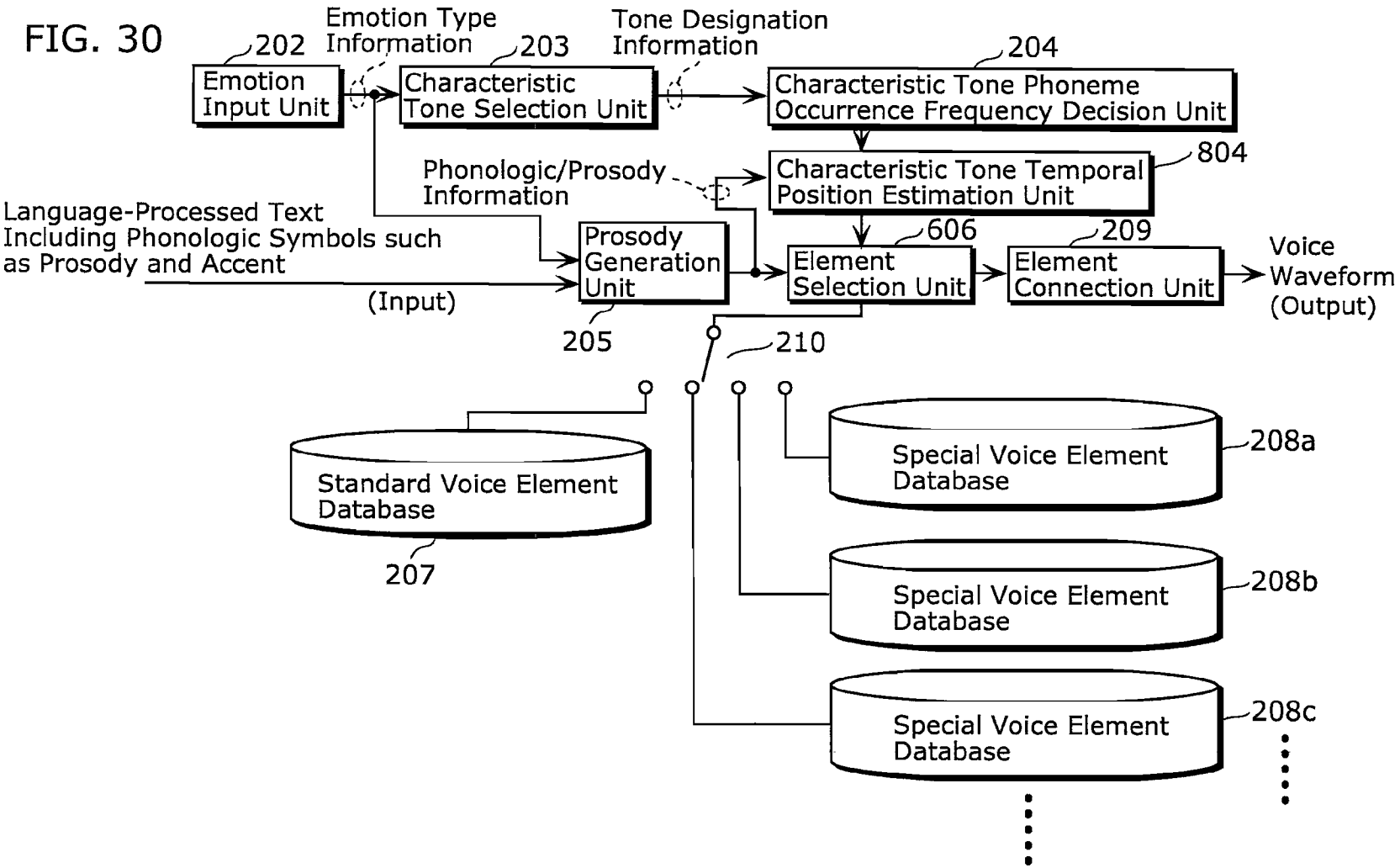
FIG. 30 is a block diagram showing a voice synthesis device according to a variation of the second embodiment of the present invention, in other words, showing a variation of the voice synthesis device of FIG. 19.
Figure 31:
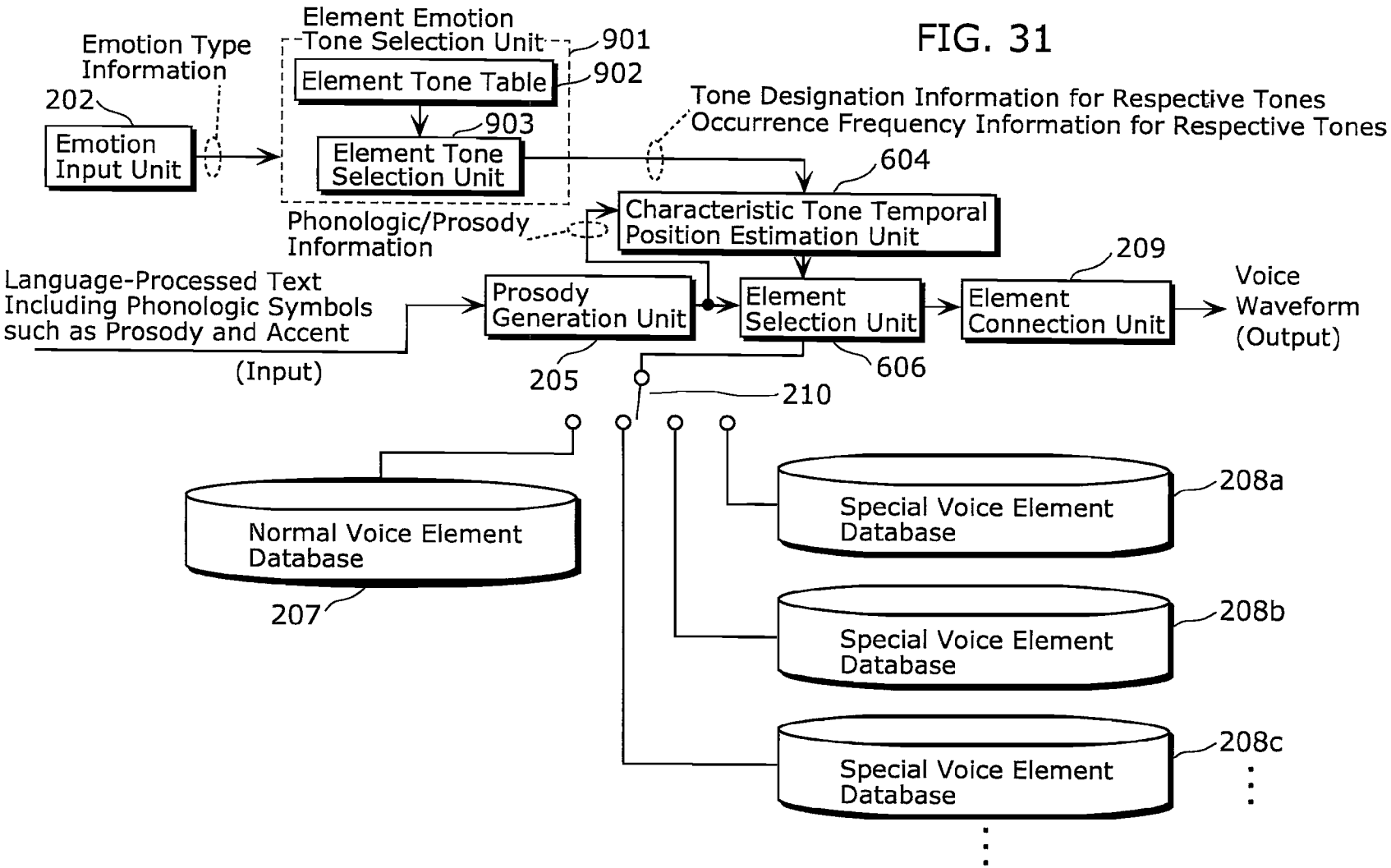
FIG. 31 is a block diagram showing a voice synthesis device according to a variation of the third embodiment of the present invention, in other words, showing a variation of the voice synthesis device of FIG. 25.

Note also that it has been described in the first to third embodiments and their variations that the language processing unit 101 obtains an input text which is a natural language, and that a phonologic sequence and language information are generated at step S2005. However, as shown in FIGS. 29, 30, and 31, the prosody generation unit may obtain a text for which the language processing has already been performed (hereinafter, referred to as "language-processed text"). Such language-processed text includes at least a phonologic sequence and prosody symbols representing positions of accents and pauses, separation between accent phrases, and the like. In the first to third embodiments and their variations, the prosody generation unit 205 and the characteristic tone temporal position estimation units 604 and 804 use language information, so that the language-processed text is assumed to further include language information such as word classes, modification relations, and the like. The language-processed text has a format as shown in FIG. 32, for example. The language-processed text shown in (a) of FIG. 32 is in a format which is used to be distributed from a server to each terminal in an information provision service for in-vehicle information terminals. The phonologic sequence is described by Katakanas (Japanese alphabets), accents' positions are shown by " ", separation of accent phrases is shown by "/", and a long pause after end of the sentence is shown by ".". (b) of FIG. 32 shows a language-processed text in which the language-processed text of (a) of FIG. 32 is added with further language information of word classes for respective words. Of course, the language information may include information in addition to the above information. If the prosody generation unit 205 obtains the language-processed text as shown in (a) of FIG. 32, the prosody generation unit 205 may generate, at step S2006, prosody information such as a fundamental frequency, power, and durations of phonemes, durations of pauses, and the like. If the prosody generation unit 205 obtains the language-processed text as shown in (b) of FIG. 32, the prosody information is generated in the same manner as the step S2006 in the first to third embodiments. In the first to third embodiments and their variations, in the either case where the prosody generation unit 205 obtains the language-processed text as shown in (a) of FIG. 32 or the language-processed text as shown in (b) of FIG. 32, the characteristic tone temporal position estimation unit 604 decides voices to be generated as special voices, based on the phonologic sequence and the prosody information generated by the prosody generation unit 205 in the same manner as the step S6004. As described above, instead of the text which is a natural language and for which language processing has not yet been performed, it is possible to obtain the language-processed text for the voice synthesis. Note that it has been described that the language-processed text of FIG. 32 is in a format where phonemes of one sentence are listed in one line. However, the language-processed text may be in other formats, for example a table which indicates phoneme, a prosody symbol, and language information for each unit such as phoneme, word, or phrase.

Figure 33:
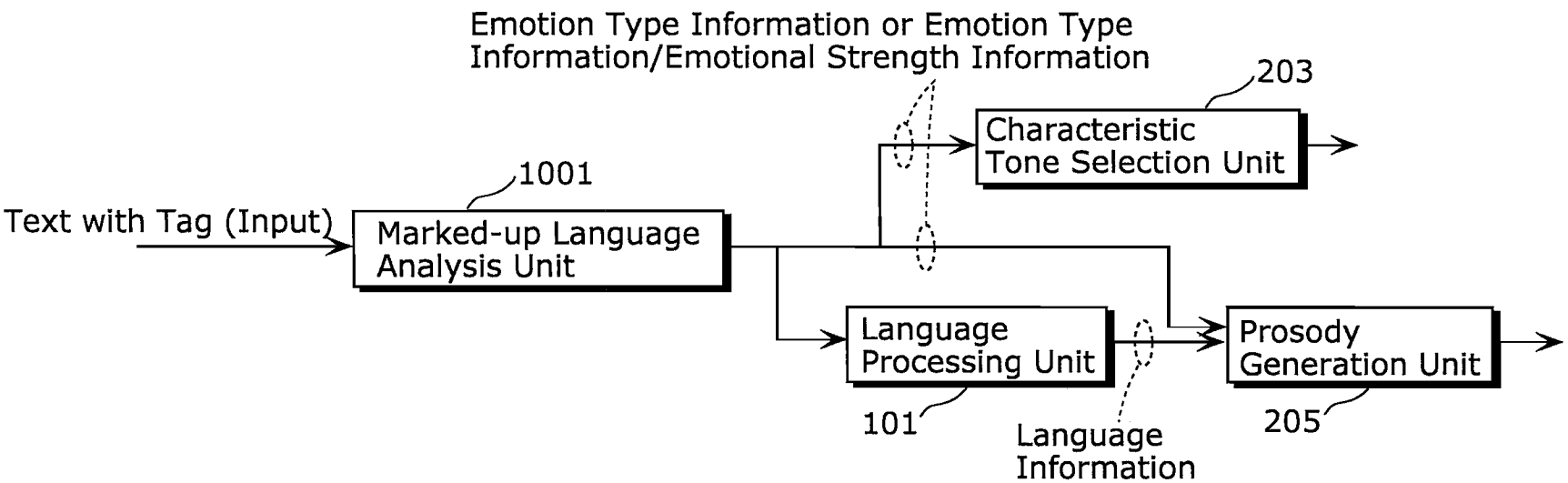
FIG. 33 is a diagram showing a voice synthesis device according to still another variation of the first and second embodiments of the present invention, in other words, showing another variation of the voice synthesis device of FIGS. 4 and 19.
Figure 34:
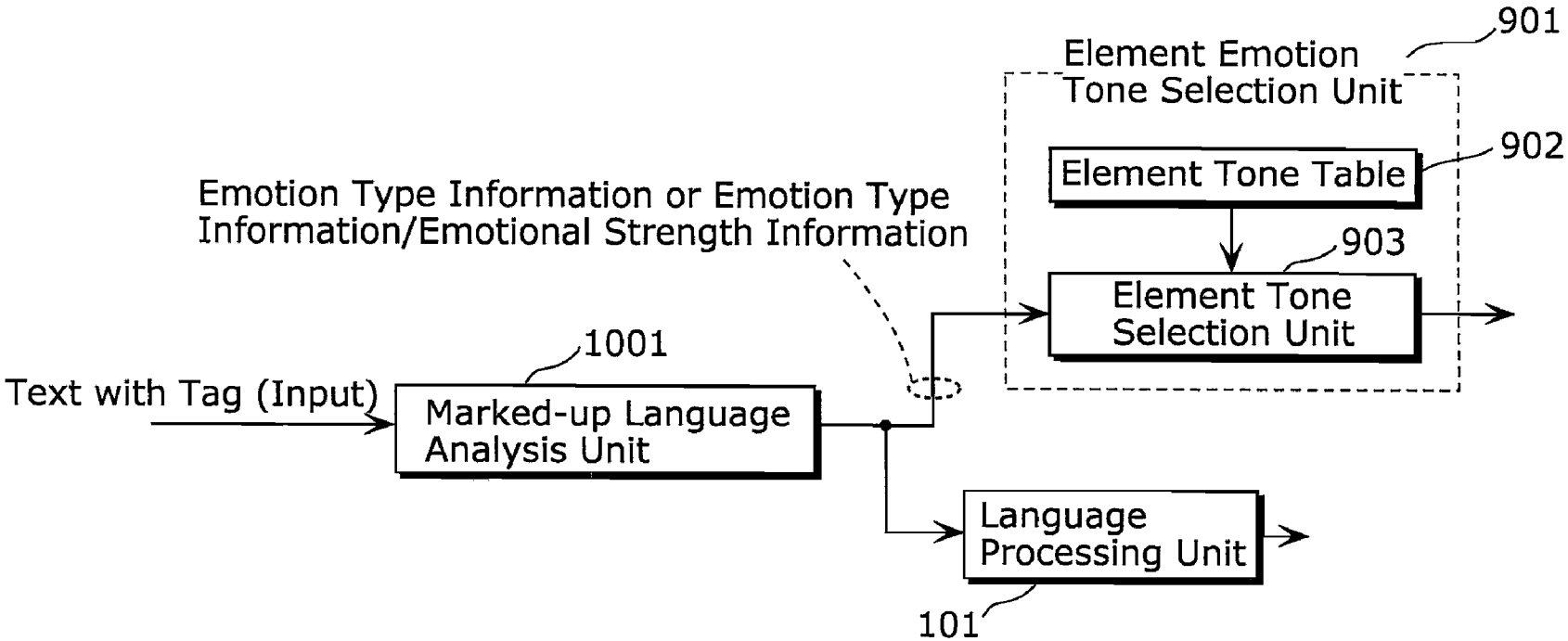
FIG. 34 is a diagram showing a voice synthesis device according to another variation of the third embodiment of the present invention, in other words, showing another variation of the voice synthesis device of FIG. 25.

Note that it has been described in the first to third embodiments and their variations, the emotion input unit 202 obtains the emotion type information or both of the emotion type information and the emotion strength information, and that the language processing unit 101 obtains an input text which is a natural language. However, as shown in FIGS. 33 and 34, a marked-up language analysis unit 1001 may obtain a text with a tag, such as VoiceXML, which indicates the emotion type information or both of the emotion type information and the emotion strength information, then separate the tag from the text part, analyze the tag, and eventually output the emotion type information or both of the emotion type information and the emotion strength information. The text with the tag is in a format as shown in (a) of FIG. 35, for example. In FIG. 35, a part between symbols "<" and ">" is a tag in which "voice" represents a command for designating a voice, and "emotion=anger[5]" represents anger as voice emotion and a degree 5 of the anger. "/voice" represents that the command starting from the "voice" line affects until the "/voice". For example, in the first or second embodiment, the marked-up language analysis unit 1001 may obtain the text with the tag of (a) of FIG. 35, and separates the tag part from the text part which describes a natural language. Then, after analyzing the content of the tag, the marked-up language analysis unit 1001 may output the emotion type and the emotion strength to the characteristic tone selection unit 203 and the prosody generation unit 205, and at the same time output the text part in which the emotion is to be expressed by voices, to the language processing unit 101. Furthermore, in the third embodiment, the marked-up language analysis unit 1001 may obtain the text with the tag of (a) of FIG. 35, and separates the tag part from the text part which describes a natural language. Then, after analyzing the content of the tag, the marked-up language analysis unit 1001 may output the emotion type and the emotion strength to the element tone selection unit 903, and at the same time output the text part in which the emotion is to be expressed by voices, to the language processing unit 101.

Figure 36:
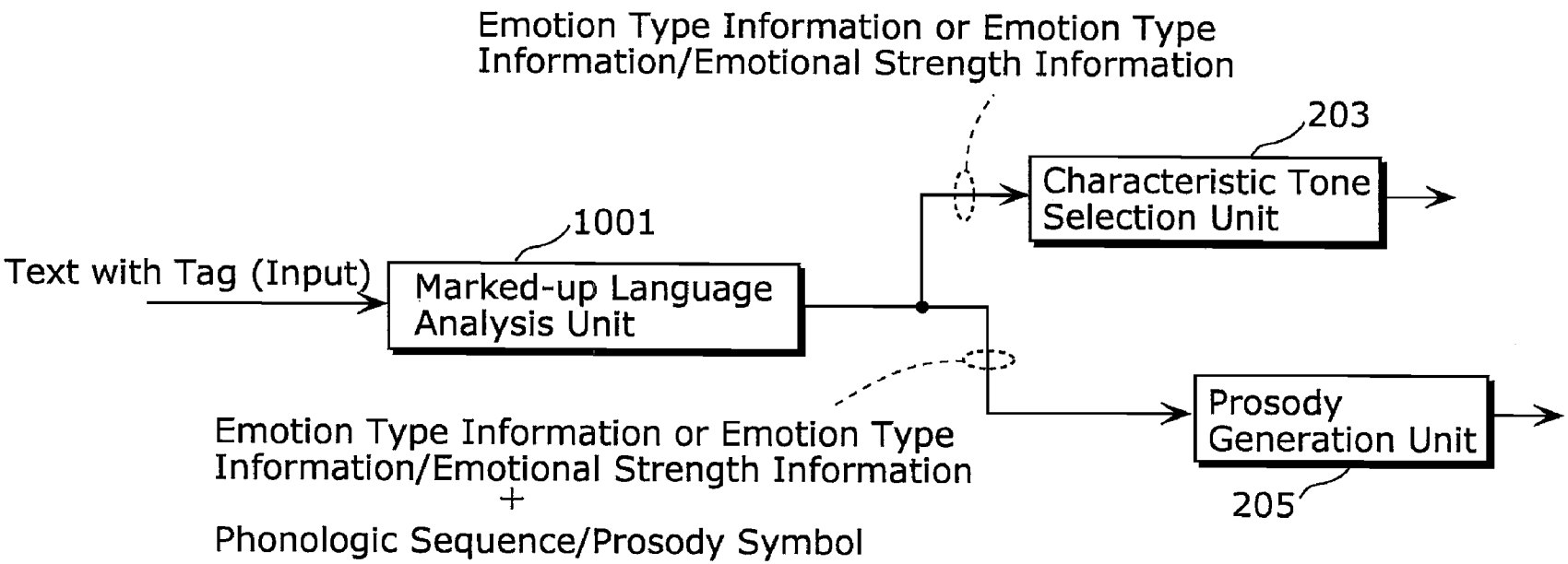
FIG. 36 is a diagram showing a voice synthesis device according to still another variation of the first and second embodiments of the present invention, in other words, showing still another variation of the voice synthesis device of FIGS. 4 and 19.
Figure 37:
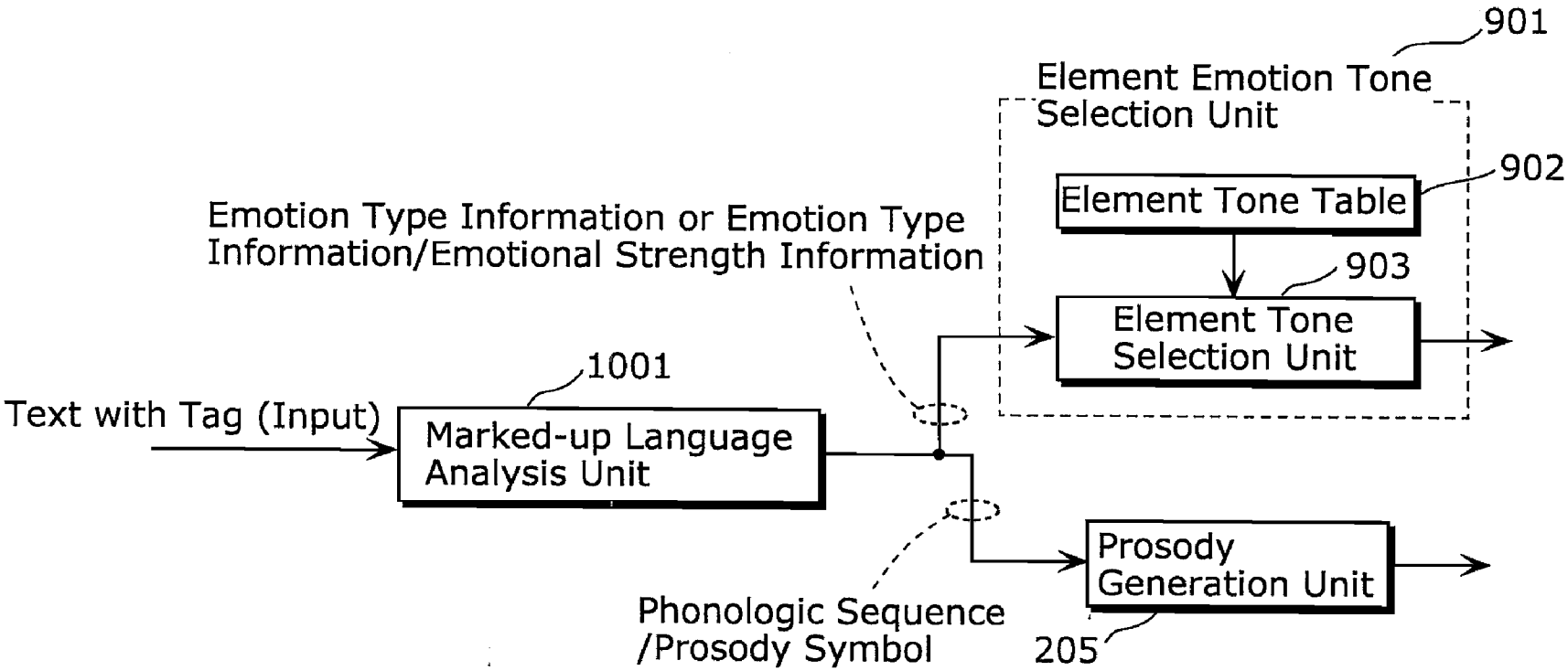
FIG. 37 is a diagram showing a voice synthesis device according to still another variation of the third embodiment of the present invention, in other words, showing still another variation of the voice synthesis device of FIG. 25.

Note that it has been described in the first to third embodiments and their variations, the emotion input unit 202 obtains at step S2001 the emotion type information or both of the emotion type information and the emotion strength information, and that the language processing unit 101 obtains an input text which is a natural language. However, as shown in FIGS. 36 and 37, the marked-up language analysis unit 1001 may obtain a text with a tag. The text is a language-processed text including at least a phonologic sequence and prosody symbols. The tag indicates the emotion type information or both of the emotion type information and the emotion strength information. Then, the marked-up language analysis unit 1001 may separate the tag from the text part, analyze the tag, and eventually output the emotion type information or both of the emotion type information and the emotion strength information. The language-processed text with the tag is in a format as shown in (b) of FIG. 35, for example. For instance, in the first or second embodiment, the marked-up language analysis unit 1001 may obtain the language-processed text with the tag of (b) of FIG. 35, and separate the tag part which indicates expression from the part of the phonologic sequence and the prosody symbols. Then, after analyzing the content of the tag, the marked-up language analysis unit 1001 may output the emotion type and the emotion strength to the characteristic tone selection unit 203 and the prosody generation unit 205, and at the same time output the part of the phonologic sequence and prosody symbols where the emotion is to be expressed by voices to the prosody generation unit 205. Furthermore, in the third embodiment, the marked-up language analysis unit 1001 may obtain the language-processed text with the tag of (b) of FIG. 35, and separate the tag part from the part of the phonologic sequence and the prosody symbols. Then, after analyzing the content of the tag, the marked-up language analysis unit 1001 may output the emotion type and the emotion strength to the element tone selection unit 903, and at the same time output the part of the phonologic sequence and prosody symbols where the emotion is to be expressed by voices to the prosody generation unit 205.

Note also that it has been described in the first to third embodiments and their variations, the emotion input unit 202 obtains the emotion type information or both of the emotion type information and the emotion strength information. However, as information for deciding an utterance style, it is also possible to further obtain designation of tension and relaxation of a phonatory organ, expression, an utterance style, way of speaking, and the like. For example, the information of tension of a phonatory organ may be information of the phonatory organ such as a larynx or a tongue and a degree of constriction of the organ, like "larynx tension degree 3". Further, the information of the utterance style may be a kind and a degree of behavior of a speaker, such as "polite 5" or "somber 2", or may be information regarding a situation of an utterance, such as a relationship between speakers, like "intimacy", or "customer interaction".

Note that it has been described in the first to third embodiments, the moras to be uttered as characteristic tones (special voices) are estimated using an estimate equation. However, if it is previously known in which mora an estimate equation easily exceeds its threshold value, it is also possible to set the mora as the characteristic tone in the voice synthesis. For example, in the case where a characteristic tone is "pressed voice", an estimate equation easily exceeds its threshold value in the following moras (1) to (4).

(1) a mora, whose consonant is "b" (a bilabial and plosive sound), and which is the third mora in an accent phrase.

(2) a mora, whose consonant is "m" (a bilabial and nasalized sound), and which is the third mora in an accent phrase (3) a mora, whose consonant is "n" (an alveolar and nasalized sound), and which is the first mora in an accent phrase (4) a mora, whose consonant is "d" (an alveolar and plosive sound), and which is the first mora in an accent phrase Furthermore, in the case where a characteristic tone is "breathy", an estimate equation easily exceeds its threshold value in the following moras (5) to (8).

(5) a mora, whose consonant is "h" (guttural and unvoiced fricative), and which is the first or third mora in an accent phrase (6) a mora, whose consonant is "t" (alveolar and unvoiced plosive sound), and which is the fourth mora in an accent phrase (7) a mora, whose consonant is "k" (velar and unvoiced plosive sound), and which is the fifth mora in an accent phrase (8) a mora, whose consonant is "s" (dental and unvoiced fricative), and which is the sixth mora in an accent phrase The voice synthesis device according to the present invention has a structure for generating voices with characteristic tones of a specific utterance mode, which partially occur due to tension and relaxation of a phonatory organ, emotion, expression of the voice, or an utterance style. Thereby, the voice synthesis device can express the voices with various expressions. This voice synthesis device is useful in electronic devices such as car navigation systems, television sets, audio apparatuses, or voice/dialog interfaces and the like for robots and the like. In addition, the voice synthesis device can apply for call centers, automatic telephoning systems in telephone exchange, and the like.

What is claimed is:

1. A voice synthesis device comprising:

an utterance mode obtainment unit operable to obtain an utterance mode of a voice waveform for which voice synthesis is to be performed, the utterance mode being determined based on at least a type of emotion;

a prosody generation unit operable to generate a prosody used when a language-processed text is uttered in the obtained utterance mode;

a characteristic tone selection unit operable to select a characteristic tone based on the obtained utterance mode, the characteristic tone being observed when the language-processed text is uttered in the obtained utterance mode;

a storage unit storing a rule, the rule being used for judging an ease of an occurrence of the selected characteristic tone based on a phoneme and a prosody;

an utterance position decision unit operable to (i) judge whether or not each of a plurality of phonemes, of a phonologic sequence of the language-processed text, is to be uttered using the selected characteristic tone, the judgment being performed based on the phonologic sequence, the selected characteristic tone, the generated prosody, and the stored rule, and (ii) determine, based on the judgment, a phoneme which is an utterance position where the language-processed text is uttered using the selected characteristic tone;

a waveform synthesis unit operable to generate the voice waveform based on the phonologic sequence, the generated prosody, and the determined utterance position, such that, in the voice waveform, the language-processed text is uttered in the obtained utterance mode and the language-processed text is uttered using the selected characteristic tone at the utterance position determined by said utterance position decision unit; and an occurrence frequency decision unit operable to determine a rate of occurrence of the selected characteristic tone, by which the language-processed text is uttered using the selected characteristic tone, wherein said utterance position decision unit is operable to (i) judge whether or not each of the plurality of phonemes, of the phonologic sequence of the language-processed text, is to be uttered using the selected characteristic tone, the judgment being performed based on the phonologic sequence, the selected characteristic tone, the generated prosody, the stored rule, and the determined rate of occurrence, and (ii) determine, based on the judgment, the phoneme which is the utterance position where the language-processed text is uttered using the selected characteristic tone, wherein said characteristic tone selection unit includes:

an element tone storage unit storing (i) the utterance mode and (ii) a group of (ii-a) a plurality of characteristic tones and (ii-b) respective rates of occurrence by which the language-processed text is to be uttered using the plurality of the characteristic tones, such that the utterance mode is stored in correspondence with the group of the plurality of characteristic tones and the respective rates of occurrence; and a selection unit operable to select, from said element tone storage unit, the group of the plurality of characteristic tones and the respective rates of occurrence, wherein the selected group corresponds to the obtained utterance mode, wherein said utterance mode obtainment unit is further operable to obtain a strength of emotion, wherein said element tone storage unit stores (i) a group of the utterance mode and the strength of emotion and (ii) a group of (ii-a) the plurality of characteristic tones and (ii-b) the respective rates of occurrence by which the language-processed text is to be uttered using the plurality of characteristic tones, such that the group of the utterance mode and the strength of emotion is stored in correspondence with the group of the plurality of characteristic tones and the respective rates of occurrence, and wherein said selection unit is operable to select, from said element tone storage unit, the group of the plurality of characteristic tones and the respective rates of occurrence, the selected group corresponding to the group of the obtained utterance mode and the strength of emotion.

2. The voice synthesis device according to claim 1, wherein said occurrence frequency decision unit is operable to determine the rate of occurrence per one of a mora, a syllable, a phoneme, and a voice synthesis unit.

3. A voice synthesis device comprising:

an utterance mode obtainment unit operable to obtain an utterance mode of a voice waveform for which voice synthesis is to be performed, the utterance mode being determined based on at least a type of emotion;

a prosody generation unit operable to generate a prosody used when a language-processed text is uttered in the obtained utterance mode;

a characteristic tone selection unit operable to select a characteristic tone based on the obtained utterance mode, the characteristic tone being observed when the language-processed text is uttered in the obtained utterance mode;

a storage unit storing a rule, the rule being used for judging an ease of an occurrence of the selected characteristic tone based on a phoneme and a prosody;

an utterance position decision unit operable to (i) judge whether or not each of a plurality of phonemes, of a phonologic sequence of the language-processed text, is to be uttered using the selected characteristic tone, the judgment being performed based on the phonologic sequence, the selected characteristic tone, the generated prosody, and the stored rule, and (ii) determine, based on the judgment, a phoneme which is an utterance position where the language-processed text is uttered using the selected characteristic tone; and a waveform synthesis unit operable to generate the voice waveform based on the phonologic sequence, the generated prosody, and the determined utterance position, such that, in the voice waveform, the language-processed text is uttered in the obtained utterance mode and the language-processed text is uttered using the selected characteristic tone at the utterance position determined by said utterance position decision unit, wherein said characteristic tone selection unit includes:

an element tone storage unit storing (i) the utterance mode and (ii) a group of (ii-a) a plurality of characteristic tones and (ii-b) respective rates of occurrence by which the language-processed text is to be uttered using the plurality of the characteristic tones, such that the utterance mode is stored in correspondence with the group of the plurality of characteristic tones and the respective rates of occurrence; and a selection unit operable to select, from said element tone storage unit, the group of the plurality of characteristic tones and the respective rates of occurrence, wherein the selected group corresponds to the obtained utterance mode, wherein said utterance position decision unit is operable to (i) judge whether or not each of the plurality of phonemes, of the phonologic sequence of the language-processed text, is to be uttered using any one of the plurality of characteristic tones, the judgment being performed based on the phonologic sequence, the group of the plurality of characteristic tones and the respective rates of occurrence, the generated prosody, and the stored rule, and (ii) determine, based on the judgment, the phoneme which is the utterance position where the language-processed text is uttered using the selected characteristic tone, wherein said utterance mode obtainment unit is further operable to obtain a strength of emotion, wherein said element tone storage unit stores (i) a group of the utterance mode and the strength of emotion and (ii) a group of (ii-a) the plurality of characteristic tones and (ii-b) the respective rates of occurrence by which the language-processed text is to be uttered using the plurality of characteristic tones, such that the group of the utterance mode and the strength of emotion is stored in correspondence with the group of the plurality of characteristic tones and the respective rates of occurrence, and wherein said selection unit is operable to select, from said element tone storage unit, the group of the plurality of characteristic tones and the respective rates of occurrence, the selected group corresponding to the group of the obtained utterance mode and the strength of emotion.

4. A voice synthesis device comprising:

an utterance mode obtainment unit operable to obtain an utterance mode of a voice waveform for which voice synthesis is to be performed, the utterance mode being determined based on at least a type of emotion;

a characteristic tone selection unit operable to select a characteristic tone based on the obtained utterance mode, the characteristic tone being observed when a language-processed text is uttered in the obtained utterance mode, the voice synthesis being applied to the language-processed text;

a storage unit storing (a) rules for determining, as phoneme positions uttered using a characteristic tone "pressed voice", (1) a mora, having a consonant "b" that is a bilabial and plosive sound, and which is a third mora in an accent phrase, (2) a mora, having a consonant "m" that is a bilabial and nasalized sound, and which is the third mora in the accent phrase, (3) a mora, having a consonant "n" that is an alveolar and nasalized sound, and which is a first mora in the accent phrase, and (4) a mora, having a consonant "d" that is an alveolar and plosive sound, and which is the first mora in the accent phrase, and (b) rules for determining, as phoneme positions uttered using a characteristic tone "breathy", (5) a mora, having a consonant "h" that is a guttural and unvoiced fricative, and which is one of the first mora and the third mora in the accent phrase, (6) a mora, having a consonant "t" that is an alveolar and unvoiced plosive sound, and which is a fourth mora in the accent phrase, (7) a mora, having a consonant "k" that is a velar and unvoiced plosive sound, and which is a fifth mora in the accent phrase, and (8) a mora, having a consonant "s" that is a dental and unvoiced fricative, and which is a sixth mora in the accent phrase;

an utterance position decision unit operable to (i) determine, in a phonologic sequence of the language-processed text and as a phoneme position uttered with the characteristic tone "pressed voice", a phoneme position satisfying any one rule of the rules (1) to (4) stored in said storage unit, when the characteristic tone selected by said characteristic tone selection unit is the characteristic tone "pressed voice", and (ii) determine, in the phonologic sequence of the language-processed text and as a phoneme position uttered with the characteristic tone "breathy", a phoneme position satisfying any one rule of the rules (5) to (8) stored in said storage unit, when the characteristic tone selected by said characteristic tone selection unit is the characteristic tone "breathy";

a waveform synthesis unit operable to generate the voice waveform, such that, in the voice waveform, the phoneme position determined by said utterance position decision unit is uttered using the characteristic tone; and an occurrence frequency decision unit operable to determine a rate of occurrence of the selected characteristic tone, by which the phoneme position determined by said utterance position decision unit is uttered using the selected characteristic tone, wherein the utterance position decision unit is operable to (i) determine based on the determined rate of occurrence, in the phonologic sequence of the language-processed text and as the phoneme position uttered with the characteristic tone "pressed voice", the phoneme position satisfying any one rule of the rules (1) to (4) stored in said storage unit, when the characteristic tone selected by said characteristic tone selection unit is the characteristic tone "pressed voice", and (ii) determine based on the determined rate of occurrence, in the phonologic sequence of the language-processed text and as the phoneme position uttered with the characteristic tone "breathy", the phoneme position satisfying any one rule of the rules (5) to (8) stored in said storage unit, when the characteristic tone selected by said characteristic tone selection unit is the characteristic tone "breathy", wherein said characteristic tone selection unit includes:

an element tone storage unit storing (i) the utterance mode and (ii) a group of (ii-a) a plurality of characteristic tones and (ii-b) respective rates of occurrence by which the language-processed text is to be uttered using the plurality of the characteristic tones, such that the utterance mode is stored in correspondence with the group of the plurality of characteristic tones and the respective rates of occurrence; and a selection unit operable to select, from said element tone storage unit, the group of the plurality of characteristic tones and the respective rates of occurrence, wherein the selected group corresponds to the obtained utterance mode, wherein said utterance position decision unit is operable to (i) judge whether or not each of the plural of phonemes, of the phonologic sequence of the language-processed text, is to be uttered using any one of the plurality of characteristic tones, the judgment being performed based on the phonologic sequence, the group of the plurality of characteristic tones and the respective rates of occurrence, the generated prosody, and the stored rule, and (ii) determine, based on the judgment, the phoneme which is the utterance position where the language-processed text is uttered using the selected characteristic tone, wherein said utterance mode obtainment unit is further operable to obtain a strength of emotion, wherein said element tone storage unit stores (i) a group of the utterance mode and the strength of emotion and (ii) a group of (ii-a) the plurality of characteristic tones and (ii-b) the respective rates of occurrence by which the language-processed text is to be uttered using the plurality of characteristic tones, such that the group of the utterance mode and the strength of emotion is stored in correspondence with the group of the plurality of characteristic tones and the respective rates of occurrence, and wherein said selection unit is operable to select, from said element tone storage unit, the group of the plurality of characteristic tones and the respective rates of occurrence, the selected group corresponding to the group of the obtained utterance mode and the strength of emotion.

5. A voice synthesis device comprising:

an utterance mode obtainment unit operable to obtain an utterance mode of a voice waveform for which voice synthesis is to be performed, the utterance mode being determined based on at least one of (i) an anatomical state of a speaker, (ii) a physiological state of the speaker, (iii) an emotion of the speaker, (iv) a feeling expressed by the speaker, (v) a state of a phonatory organ of the speaker, (vi) a behavior of the speaker, and (vii) a behavior pattern of the speaker;

a prosody generation unit operable to generate a prosody used when a language-processed text is uttered in the obtained utterance mode;

a characteristic tone selection unit operable to select a characteristic tone based on the obtained utterance mode, the characteristic tone being observed when the language-processed text is uttered in the obtained utterance mode;

a storage unit storing a rule, the rule being used for judging an ease of an occurrence of the selected characteristic tone based on a phoneme and a prosody;

an utterance position decision unit operable to (i) judge whether or not each of a plurality of phonemes, of a phonologic sequence of the language-processed text, is to be uttered using the selected characteristic tone, the judgment being performed based on the phonologic sequence, the selected characteristic tone, the generated prosody, and the stored rule, and (ii) determine, based on the judgment, a phoneme which is an utterance position where the language-processed text is uttered using the selected characteristic tone;

a waveform synthesis unit operable to generate the voice waveform based on the phonologic sequence, the generated prosody, and the determined utterance position, such that, in the voice waveform, the language-processed text is uttered in the obtained utterance mode and the language-processed text is uttered using the selected characteristic tone at the utterance position determined by said utterance position decision unit; and an occurrence frequency decision unit operable to determine a rate of occurrence of the selected characteristic tone, by which the language-processed text is uttered using the selected characteristic tone, wherein said utterance position decision unit is operable to (i) judge whether or not each of the plurality of phonemes, of the phonologic sequence of the language-processed text, is to be uttered using the selected characteristic tone, the judgment being performed based on the phonologic sequence, the selected characteristic tone, the generated prosody, the stored rule, and the determined rate of occurrence, and (ii) determine, based on the judgment, the phoneme which is the utterance position where the language-processed text is uttered using the selected characteristic tone, wherein said characteristic tone selection unit includes:

an element tone storage unit storing (i) the utterance mode and (ii) a group of (ii-a) a plurality of characteristic tones and (ii-b) respective rates of occurrence by which the language-processed text is to be uttered using the plurality of the characteristic tones, such that the utterance mode is stored in correspondence with the group of the plurality of characteristic tones and the respective rates of occurrence; and a selection unit operable to select, from said element tone storage unit, the group of the plurality of characteristic tones and the respective rates of occurrence, wherein the selected group corresponds to the obtained utterance mode, wherein said utterance mode obtainment unit is further operable to obtain a strength of emotion, wherein said element tone storage unit stores (i) a group of the utterance mode and the strength of emotion and (ii) a group of (ii-a) the plurality of characteristic tones and (ii-b) the respective rates of occurrence by which the language-processed text is to be uttered using the plurality of characteristic tones, such that the group of the utterance mode and the strength of emotion is stored in correspondence with the group of the plurality of characteristic tones and the respective rates of occurrence, and wherein said selection unit is operable to select, from said element tone storage unit, the group of the plurality of characteristic tones and the respective rates of occurrence, the selected group corresponding to the group of the obtained utterance mode and the strength of emotion.

* * * * *